US009732495B2

(12) United States Patent
Congdon

(10) Patent No.: US 9,732,495 B2
(45) Date of Patent: Aug. 15, 2017

(54) IMPLEMENT CUTTING EDGE WEAR MEMBER

(71) Applicant: Caterpillar Inc., Peoria, IL (US)

(72) Inventor: Thomas Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 191 days.

(21) Appl. No.: 14/445,883

(22) Filed: Jul. 29, 2014

(65) Prior Publication Data

US 2016/0032558 A1 Feb. 4, 2016

(51) Int. Cl.
*E02F 3/815* (2006.01)
*E02F 9/28* (2006.01)

(52) U.S. Cl.
CPC ..... *E02F 3/8152* (2013.01); *E02F 9/2858* (2013.01)

(58) Field of Classification Search
CPC ..... E02F 3/8152
USPC ..... 172/701.2, 701.3
See application file for complete search history.

(56) References Cited

U.S. PATENT DOCUMENTS 2,732,639 A 1/1956 Lillengreen
2,866,280 A * 12/1958 O'Connor ..... E02F 3/8152 172/701.3
2,965,989 A 12/1960 Hibbard
3,029,534 A 4/1962 Rakisits
3,456,370 A 7/1969 Gilbertson
3,529,677 A * 9/1970 Stephenson ..... E02F 9/285 172/701.3
3,851,711 A 12/1974 Stepe
3,961,788 A 6/1976 Helton et al.
4,086,967 A 5/1978 Eftefield et al.
4,208,817 A * 6/1980 Merkel ..... E02F 3/6454 172/702
4,290,214 A * 9/1981 Stepe ..... E02F 9/2808 172/701.2
4,770,253 A * 9/1988 Hallissy ..... E01H 5/061 172/701.3
5,427,186 A 6/1995 Adrian et al.
5,881,480 A * 3/1999 Fall ..... E02F 9/285 172/701.3

(Continued)

FOREIGN PATENT DOCUMENTS

JP 2001-040692 A 2/2001
WO 2007129947 11/2007
WO WO 2013/112102 A1 8/2013

*Primary Examiner* — Thomas B Will
*Assistant Examiner* — Joel F. Mitchell
(74) *Attorney, Agent, or Firm* — Leydig, Voit & Mayer, Ltd.

(57) ABSTRACT

A wear member for an earth-working implement including a body having front, rear, top, bottom, inner side and outer side portions. The wear member includes a front face defined on the front portion with a front cutout surface, a front lower surface, and a front upper surface. The wear member includes a rear face on the rear portion facing away from the front face. The wear member includes a front cutout on the front face defining the front cutout surface between the front lower surface and the front upper surface. The front cutout surface extends between the inner side portion and the outer side portion and offset from the front upper surface and the front lower surface toward the rear face. The front lower surface and the front upper surface are co-planar and parallel to the front cutout surface and the rear face.

15 Claims, 13 Drawing Sheets

(56) References Cited

U.S. PATENT DOCUMENTS

| | | | | |
|---|---|---|---|---|
| 6,854,527 | B2 * | 2/2005 | Manway | E02F 3/8152 172/701.1 |
| 7,874,085 | B1 | 1/2011 | Winter et al. | |
| 8,191,287 | B2 | 6/2012 | Winter et al. | |
| 2011/0162241 | A1 * | 7/2011 | Wangsness | E01H 5/066 37/266 |

* cited by examiner

IMPLEMENT CUTTING EDGE WEAR MEMBER

TECHNICAL FIELD

This disclosure relates generally to ground engaging tools and, more particularly, to ground engaging tools on buckets, blades, and other work tools used with mining and construction machinery.

BACKGROUND

Different types of mining and construction machines, such as tractors, bulldozers, backhoes, excavators, motor graders, and mining trucks commonly employ earth-working blades to move and level earth or materials being excavated or loaded. The earth-working blades frequently experience extreme wear from repeated contact with highly abrasive materials encountered during operation. Replacement of the earth-working blades and other implements used in mining and construction machinery can be costly and labor intensive.

The earth-working blades can be equipped with a ground engaging tool (GET), such as a cutting-bit, a set of cutting-bits or other wear members, to help protect the blade and other earth-working tools from wear. Typically, a wear member can be in the form of teeth, edge protectors, tips, or other removable components that can be attached to the areas of the blade or other tool where most damaging and repeated abrasions and impacts occur. For example, a GET in the form of edge protectors can wrap around an implement's cutting edge to help protect it from excessive wear.

In such applications, the removable wear members can be subjected to wear from abrasion and repeated impact, while helping to protect the blade or other implement to which they can be mounted. When the wear member becomes worn through use, it can be removed and replaced with a new wear member or other GET at a reasonable cost to permit the continued use of the implement. By protecting the implement with a GET and replacing the worn GET at appropriate intervals, significant cost and time savings are possible.

The cost and time savings available from using a wear member to protect large machine implements can be further enhanced by increasing the ability of the wear member to cut through the working material and by increasing the useful life of the wear member itself without significantly increasing the material needed to make the wear member. Currently known wear members, particularly wear members constructed using standard construction such as the International Organization for Standardization (ISO), can encounter efficiency problems. One problem encountered with some wear members constructed by ISO standards is a "ski effect," in which a newly mounted wear member will simply skim across the top of a work surface until enough of the wear member has worn away to effect proper work surface penetration. There is an ongoing need in the art for improved wear member systems that increase wear efficiency and cutting effectiveness, thus increasing the efficiency of earth-working machinery and increasing overall work productivity.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes a wear member for an earth-working implement. The wear member includes a body having front, rear, top, bottom, inner side and outer side portions. The wear member includes a front bottom edge defined along at least a portion of a front bottom interface between the front portion and the bottom portion, the front bottom edge aligned along a longitudinal axis. The wear member includes a front top edge defined along at least a portion of a front top interface between the front portion and the top portion, where the front top edge substantially parallel to the front bottom edge. The wear member includes a front inner side edge defined along at least a portion of a front inner side interface between the inner side portion and the front portion, and a front outer side edge defined along at least a portion of a front outer side interface between the outer side portion and the front portion. The wear member includes a front face defined on the front portion, the front face extending between the front inner side edge, the front outer side edge, the front top edge, and the front bottom edge. The wear member also includes a front cutout formed in the front face and delimited by a front upper cutout edge and a front lower cutout edge, the front upper cutout edge is disposed between the front top edge and the front bottom edge, and the front lower cutout edge disposed between the front upper cutout edge and the front bottom edge. The wear member includes a front lower surface defined on the front face between the front lower cutout edge and the front bottom edge, and a front upper surface defined on the front surface between the front upper cutout edge and the front top edge. The wear member includes a front cutout surface is defined by the front cutout between the front lower cutout edge and the front upper cutout edge. The front cutout surface is offset from the front lower surface and the front upper surface in a direction along a normal axis defined perpendicular to the longitudinal axis. The body is configured to be mounted to a mounting edge of the earth-working implement such that the front face faces a direction away from the earth-working implement.

In another embodiment, the present disclosure describes a wear member for an earth-working implement. The wear member includes a body having front, rear, top, bottom, inner side and outer side portions. The wear member includes a front bottom edge defined along at least a portion of a front bottom interface between the front portion and the bottom portion, where the front bottom edge is aligned along a longitudinal axis. The wear member includes a front top edge defined along at least a portion of a front top interface between the front portion and the top portion, wherein the front top edge is substantially parallel to the front bottom edge. The wear member includes a front inner side edge defined along at least a portion of a front inner side interface between the inner side portion and the front portion. The wear member includes a front outer side edge defined along at least a portion of a front outer side interface between the outer side portion and the front portion. The wear member includes a front face defined on the front portion, wherein the front face extends between the front inner side edge, the front outer side edge, the front top edge, and the front bottom edge. The wear member includes a front cutout formed in the front face and delimited by a front upper cutout edge and a front lower cutout edge, the front upper cutout edge disposed between the front top edge and the front bottom edge, and the front lower cutout edge disposed between the front upper cutout edge and the front bottom edge. The wear member includes a front lower surface defined on the front face between the front lower cutout edge and the front bottom edge. The wear member includes a front upper surface defined on the front surface between the front upper cutout edge and the front top edge, wherein the front upper surface is substantially co-planar with the front lower surface. The wear member includes a front cutout surface defined by the front cutout between the front lower cutout edge and the front upper cutout edge. The front cutout surface is offset from the front lower surface and the front upper surface in a direction along a normal axis defined perpendicular to the longitudinal axis. The wear member includes a rear bottom edge defined along at least a portion of a rear bottom interface between the bottom portion and the rear portion, where the rear bottom edge is substantially parallel to the front bottom edge. The wear member includes a rear top edge defined along at least a portion of a rear top interface between the top portion and the rear portion, where the rear top edge is substantially parallel to the front top edge. The wear member includes a rear inner side edge defined along at least a portion of a rear inner side interface between the front inner side portion and the rear portion, and a rear outer side edge defined along at least a portion of a rear outer side interface between the outer side portion and the rear portion. The wear member includes a rear face defined on the rear portion. The rear face extends between the rear inner side edge, the rear outer side edge, the rear top edge, and the rear bottom edge. The rear face is substantially parallel to the front cutout surface, the front upper surface, and the front lower surface. The body is configured to be mounted to a mounting edge of the earth-working implement such that the front face faces a direction away from the earth-working implement.

In another embodiment, the present disclosure describes a wear member for an earth-working implement. The wear member includes a body having front, rear, top, bottom, inner side and outer side portions. The wear member includes a front face defined on the front portion. The front face includes a front cutout surface, a front lower surface, and a front upper surface. The wear member includes a rear face defined on the rear portion and facing generally away from the front face. The wear member includes a front cutout formed into the front face and defining the front cutout surface between the front lower surface and the front upper surface. The front cutout surface extends between the inner side portion and the outer side portion and is offset from the front upper surface and the front lower surface in a direction toward the rear face. The front lower surface and the front upper surface are substantially co-planar, and the front cutout surface is substantially parallel to the front lower surface, the front upper surface, and the rear face.

Further and alternative aspects and features of the disclosed principles will be appreciated from the following detailed description and the accompanying drawings. As will be appreciated, the principles related to end cutting-bits disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
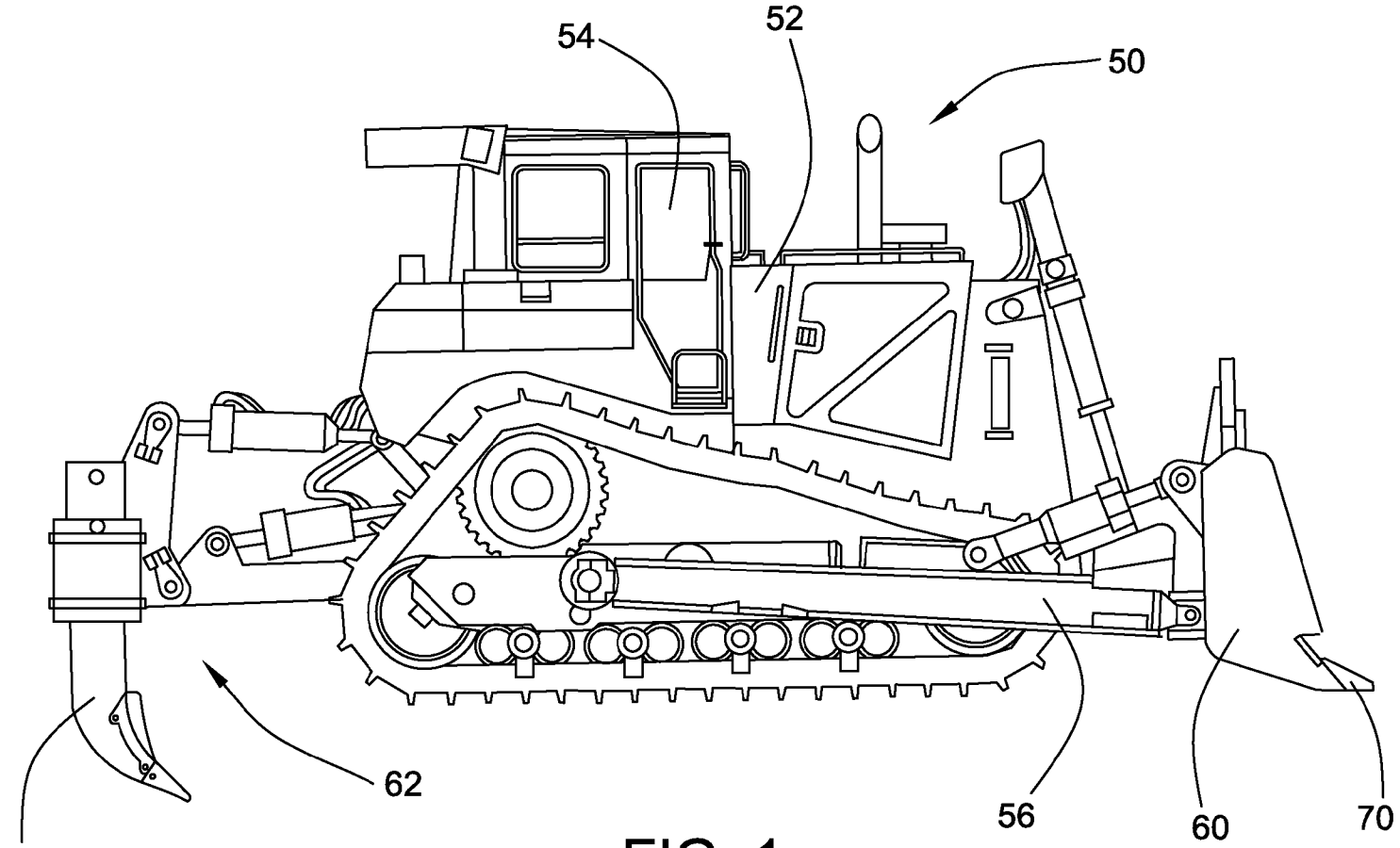
FIG. 1 is a diagrammatic side elevational view of an embodiment of a machine including an embodiment of an earth-working implement including a wear member constructed in accordance with principles of the present disclosure.

This disclosure relates to GET assemblies and systems, specifically earth-working implement wear members, cutting bits, or cutting edges utilized in various types of mining, earth-working, and construction machinery. FIG. 1 shows an embodiment of a machine 50 in the form of a track-type tractor that can include an embodiment of an implement wear member 100 constructed in accordance with principles of the present disclosure. Among other uses, a track-type tractor can be used to move and strip working material in various surface mining or other construction applications.

As shown in FIG. 1, the machine 50 can include a body 52 with a cab 54 to house a machine operator. The machine 50 can also include an arm system 56 pivotally connected at one end to the body 52 or undercarriage and supporting an earth-working implement assembly 60 at an opposing, distal end. In embodiments, the implement assembly 60 can include any suitable implement, such as an earth-working blade, or any other type of suitable device usable with wear member 100. The illustrated machine 50 also includes a ripper assembly 62 having a ripper 64 opposite the implement assembly 60. The ripper 64 can be used to cut through and break up working material for removal. A control system can be housed in the cab 54 that can be adapted to allow a machine operator to manipulate and articulate the implement assembly 60 and/or the ripper assembly 62 for digging, excavating, or any other suitable application.

Figure 2:
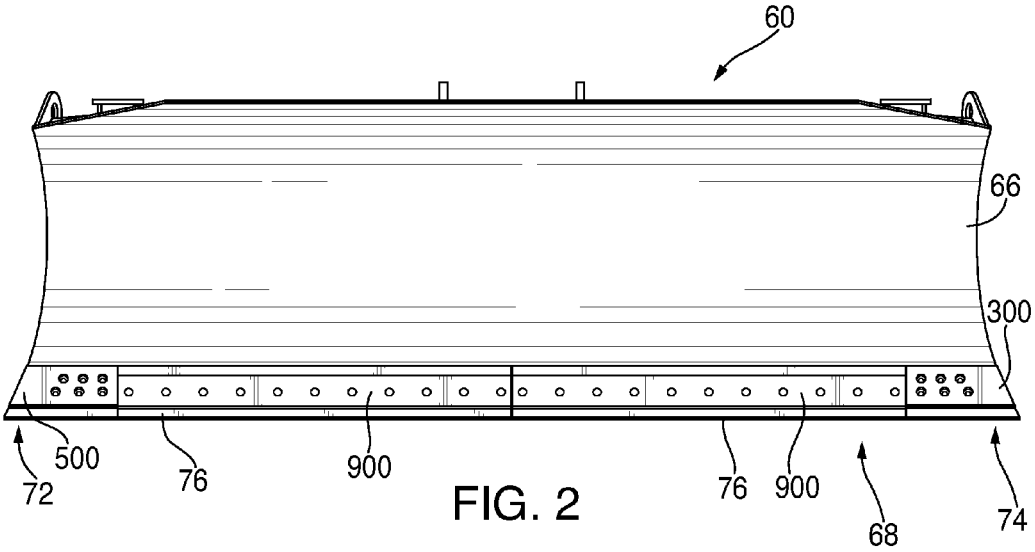
FIG. 2 is a front view of the earth-working implement of FIG. 1.

FIG. 2 shows an embodiment of the implement assembly 60. Referring to FIG. 2, the implement assembly 60 can include an earth-working blade 66 that can have a mounting edge 68 adapted to engage the ground or other excavation or work surface. The mounting edge 68 can be adapted to receive a plurality of wear members, including both intermediate cutting-bits or cutting edges 900 and end cutting-bits 300, 500. The end cutting-bits 300, 500 can be arranged on the mounting edge 68 at a first blade end 74 and a second blade end 72, respectively. In some embodiments, the end cutting-bit 300 mounted to the first blade end 74 of the mounting edge 68 can be symmetrical to the end cutting-bit 500 mounted to the second blade end 72 of the mounting edge 68. In the illustrated embodiment, the intermediate cutting edge 900 can be mounted along the mounting edge 68 between the end cutting-bits 300, 500. Each intermediate cutting edge 900 can have a cutting edge 76 that can contact the working material during machine operation. Although FIG. 2 illustrates two end-bits 300, 500 and three intermediate cutting edges 900, it is contemplated that any number of end-bits and intermediate cutting edges of varying shapes and sizes can be used. In some embodiments, it is contemplated that no intermediate cutting edges are used, and in other embodiments, it is contemplated that no end-bits are used and intermediate cutting edges span from the first to the second end of the earth-working blade or other implement. Through repeated use, the end cutting-bits 300, 500, the intermediate cutting edge 900, or any other combination of wear members can be subjected to wear and eventually can be replaced to allow the further use of the implement assembly 60.

Although FIGS. 1 and 2 illustrate the use of certain embodiments of wear members constructed in accordance with principles of the present disclosure with blade of a track-type tractor, many other types of implements and mining and construction machinery can benefit from using wear members as described herein. It should be understood that, in other embodiments, wear members constructed in accordance with principles of the present disclosure can be used in a variety of other implements and/or machines.

Figure 3:
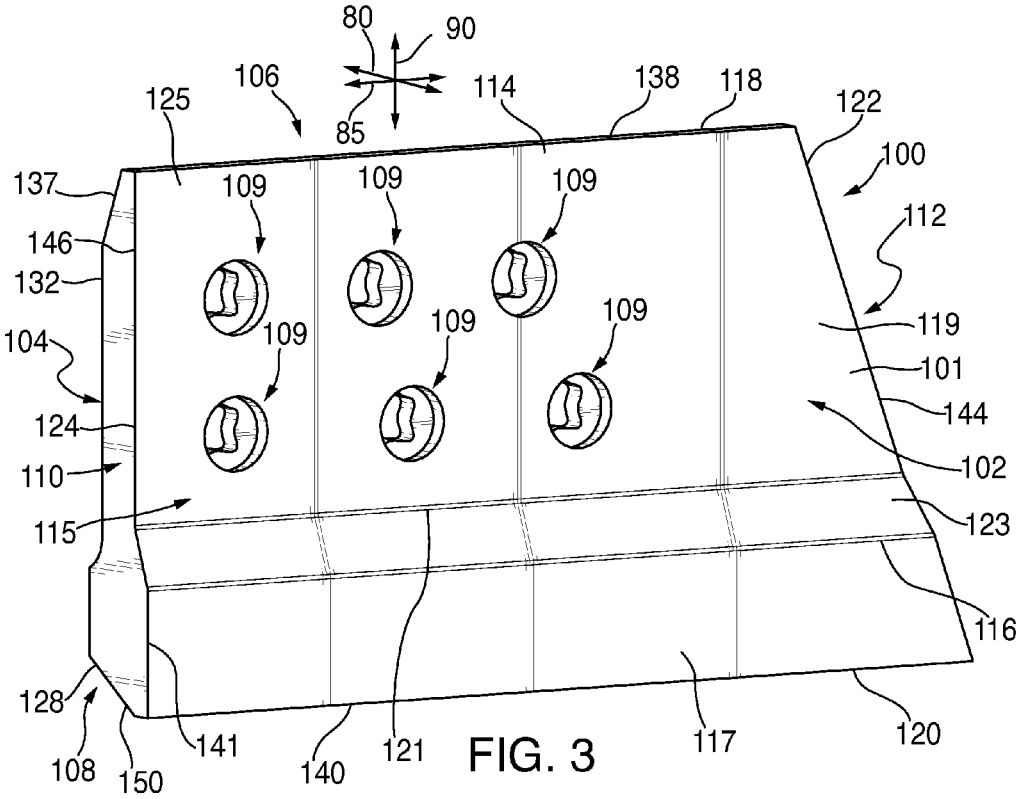
FIG. 3 is a front-left perspective view of an embodiment of a wear member constructed in accordance with the principles of the present disclosure.
Figure 4:
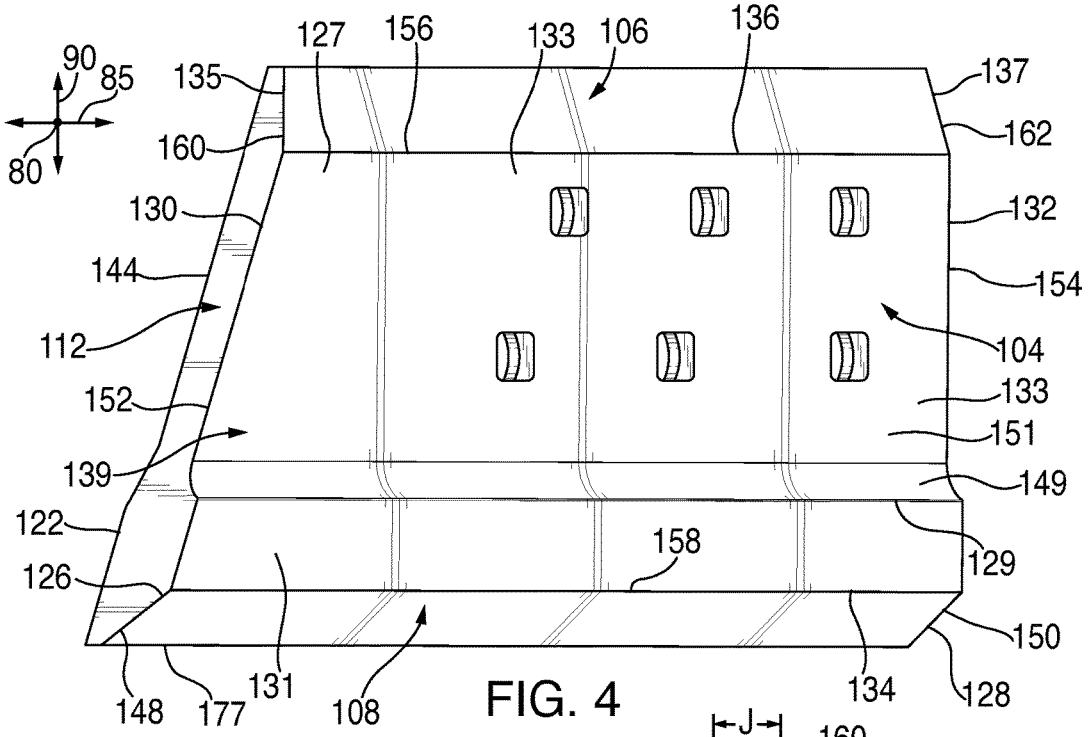
FIG. 4 is a rear-right perspective view of the wear member of FIG. 3.
Figure 5:
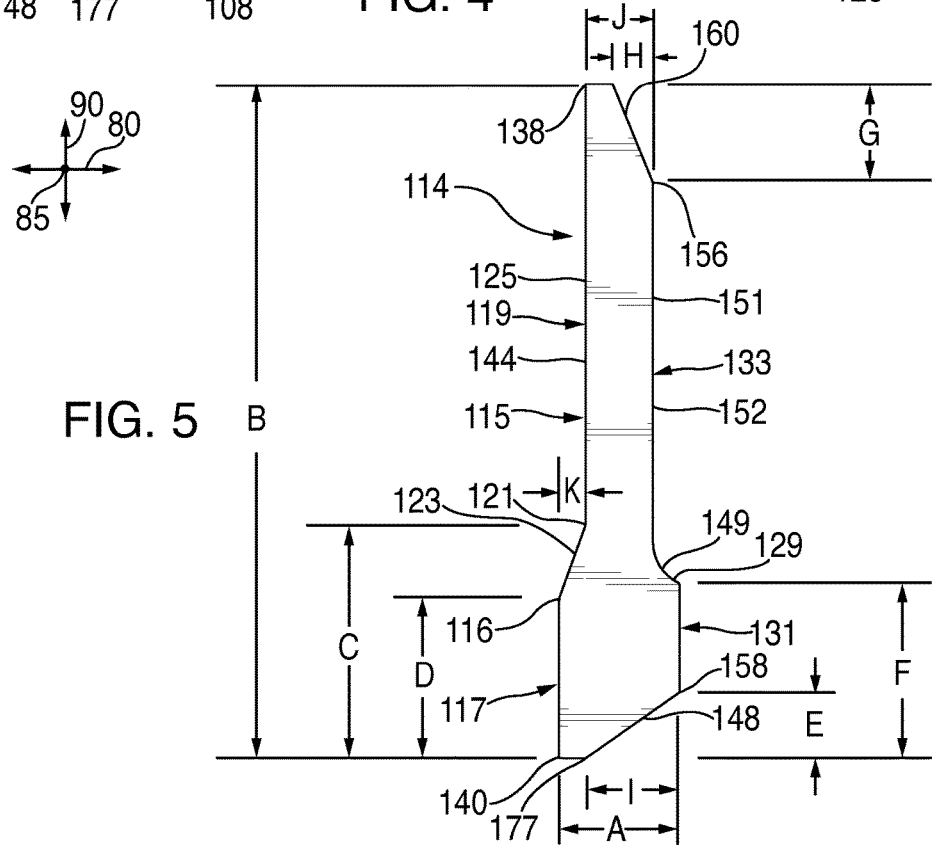
FIG. 5 is a right side view of the wear member of FIG. 3.

FIGS. 3-5 illustrate views of an embodiment of a wear member, specifically an end cutting-bit 100. As will be discussed, the specific geometry of end cutting-bit 100 can provide for increased wear life. Referring to FIGS. 3-4, the end cutting-bit 100 can be formed from a body 101 that can have a generally trapezoidal shape. The body 101 can have a front portion 102, a rear portion 104, a top portion 106, a bottom portion 108, an inner side portion 110, and an outer side portion 112. Interfaces can exist between each of the adjacent portions. Specifically, a front top interface 118 can exist between the top portion 106 and the front portion 102, and a front bottom interface 120 can exist between the front portion and the bottom portion 108. A front outer side interface 122 can exist between the front portion 102 and the outer side portion 112, and a front inner side interface 124 can exist between the front portion and the inner side portion 110. An outer bottom interface 126 can exist between the bottom portion 108 and the outer side portion 112, and an inner bottom interface 128 can exist between the inner side portion 110 and the bottom portion 108. Additionally, a rear outer side interface 130 can exist between the outer side portion 112 and the rear portion 104, and a rear inner side interface 132 can exist between the inner side portion 110 and the rear portion. A rear bottom interface 134 can exist between the rear portion 104 and the bottom portion 108, and a rear top interface 136 can exist between the top portion 106 and the rear portion. Finally, in some embodiments, an outer top interface 135 can exist between the outer side portion 112 and the top portion 106, and an inner top interface 137 can exist between the inner side portion 110 and the top portion.

In some embodiments, a plurality of mounting orifices 109 can be formed in the body 101, creating passages between the front portion 102 and the rear portion 104 of the body. The mounting orifices 109 can be adapted to receive mounting hardware, such as bolts, screws, rivets, or other mounting tools suitable to secure the end cutting-bit 100 to an implement. In some embodiments, the mounting orifices 109 can be countersunk to provide a smooth, flush surface on the front portion 102. While the embodiment illustrated in FIGS. 3-4 shows six mounting orifices 109 adapted to receive six sets of mounting hardware, it is contemplated that any number of mounting orifices can be used in other embodiments. It is also contemplated that alternative mounting methods can be used to mount the end cutting-bit 100 or other wear members to an earth-working blade or other implement.

Each interface on the body 101 can define one or more edges that can define surfaces on the body. Specifically, a front top edge 138 can be disposed along the front top interface 118, and a front bottom edge 140 can be disposed along at least a portion of the bottom interface 120 between the inner side portion 110 and the outer side portion 112. A front outer side edge 144 can be disposed along the front outer side interface 122 between the front top edge 138 and the front bottom edge 140, and a front inner side edge 146 can be disposed along the front inner side interface 124 between the front top edge 138 and the front bottom edge 140. Additionally, the body 101 can include an outer bottom edge 148 disposed along the outer bottom interface 126 between the front bottom edge and the rear portion 104, and an inner bottom edge 150 disposed along the inner bottom interface 128 between the front bottom edge 140 and the rear portion. A rear outer side edge 152 can be disposed along the rear outer side interface 130 and extend between the top portion 106 and the outer bottom edge 148, and a rear inner side edge 154 can be disposed along the rear inner side interface 132 between the top portion and the inner bottom edge 150. A rear top edge 156 can be disposed along the rear top interface 136 and extend between the outer rear edge 152 and the inner rear edge 154, and a rear bottom edge 158 can be disposed along the rear bottom interface 134 between the outer rear edge and the inner rear edge. Further, in some embodiments, an outer top edge 160 can be defined along the outer top interface 135 between the front top edge 138 and the rear top edge 156, and an inner top edge 162 can be defined along the inner top interface 137 between the front top edge and the rear top edge. In some embodiments, the various edges can be chamfered to form rounded edges and corners to the body 101. It is contemplated, however, that the edges of the body 101 can have sharp corners, angled bevels, or any other suitable shape.

As best shown in FIGS. 3-4, the front portion 102 of the body 101 can define a front face 114. The front face 114 can extend between the front inner side edge 146, the front outer side edge 144, the front top edge 138, and the front bottom edge 140. The body 101 can be configured to be mounted to the mounting edge 68 of the earth-working implement 60 such that the front face 114 faces a direction away from the earth-working implement. The front face 114 can include a front lower cutout edge 116 between the front bottom edge 140 and the front top edge 138. A front cutout 115 can be formed in the front face 114. The front cutout 115 can be delimited by the front lower cutout edge 116 and the front top edge 138, and a cutout surface 119 can be defined by the front cutout. A front lower surface 117 can be defined on the front face 114 between the front bottom edge 140 and the front lower cutout edge 116, and the front cutout surface 119 can be defined on the front face between the front lower cutout edge and the front top edge 138. In certain embodiments, the front lower cutout edge 116 can be substantially parallel to the front bottom edge 140, but other geometric orientations are contemplated. The front inner side edge 146 can include an inner lower front portion 141 defined adjacent the front lower surface 117 along the front inner side interface 124 between the inner side portion 110 and the front portion 102. A transition seam 121 can be formed in the front face 114 between the front lower cutout edge 116 and the front top edge 138. The front cutout surface 119 can include a front transition cutout portion 123 defined between the transition seam 121 and the front lower cutout edge 116, and a front base cutout portion 125 defined between the transition seam and the front top edge 138. Thus, in some embodiments, the front face 114 includes the front lower surface 117, the front transition cutout portion 123 of the front cutout surface 119, and the front base cutout portion 125 of the front cutout surface. In certain embodiments, the front base cutout portion 125 can be substantially parallel to the front lower surface 117 and the transition cutout portion 123 can connect the two at an angle such that the front base cutout portion is offset from the front lower surface in a direction toward the rear portion 104. However, other, non-parallel surface orientations are also contemplated.

The body 101 can also include a rear face 127 defined on the rear portion 104. The rear face 127 can extend between the rear inner side edge 154, the rear outer side edge 152, the rear top edge 156, and the rear bottom edge 158. The rear face 127 can include a rear lower cutout edge 129 disposed between the rear bottom edge 158 and the rear top edge 156. A rear cutout 139 can be formed in the rear face 127 and can be delimited by the rear lower cutout edge 129 and the rear top edge 156. The rear face 127 can further include a rear lower surface 131, which can be defined between the rear bottom edge 158 and the rear lower cutout edge 129, and a rear cutout surface 133, which can be defined by the rear cutout 139 between the rear lower cutout edge and the rear top edge 156. The rear cutout surface 133 can include a rear transition cutout portion 149 and a rear base cutout portion 151. In some embodiments, the rear base cutout portion 151 can be substantially flat and substantially parallel to the front base cutout portion 125. Additionally, in some embodiments, the rear lower surface 131 can be substantially parallel to the front lower surface 117, though other, non-parallel geometric orientations are contemplated.

For the purpose of illustration, the figures indicate a normal axis 80, a lateral axis 90, and a longitudinal axis 85, all of which are defined perpendicular to one another. In FIGS. 3-5, for the purposes of illustration, the body 101 of the end cutting-bit 100 is aligned such that the front bottom edge 140 is defined substantially along the longitudinal axis 85, and the inner lower front portion 141 is aligned with the lateral axis 90.

Referring now to FIG. 5, the following ratios between certain dimensional features of the wear member 100 are not meant to be exhaustive, but are merely examples of geometric ratios for dimensions of the wear member disclosed herein. The body 101 can have a body thickness A measured along the normal axis 80 between the front lower surface 117 and the rear face 127 or, more specifically, the rear lower surface 131. The body 101 can have a body height B measured as the distance along the lateral axis 90 between the front bottom edge 140 and the front top edge 138. The body 101 can have a transition seam height C measured along the lateral axis 90 between the front bottom edge 140 and the transition seam 121. The front lower surface 117 can have a front lower surface height D measured as the distance along the lateral axis 90 between the front bottom edge 140 and the front lower cutout edge 116. The rear bottom edge 158 can have a rear bottom edge height E measured along the lateral axis 90 between the front bottom edge 140 and the rear bottom edge 158. The rear lower surface 131 can have a rear lower surface height F measured along the lateral axis 90 between the front bottom edge 140 and the rear lower cutout edge 129. The rear top edge 156 can have a rear top edge height G measured along the lateral axis 90 between the front top edge 138 and the rear top edge 156. A top cutaway depth H can be measured along the normal axis between an top cutaway edge 190 and the rear top edge 156. A bottom cutaway depth I can be measured along the normal axis 80 between a bottom wear edge 177 and the rear bottom edge 158. The body 101 can have a cutout thickness J measured along the normal axis 80 between the front base cutout portion 125 and the rear base cutout portion 151. The front cutout 115 in the front face 114 can have a front cutout depth K measured as the distance along the normal axis 80 between the front lower surface 117 and the front base cutout portion 125.

In some embodiments, a ratio between the front lower surface height D and the body height B can be in a range between about 1:10 and about 3:10, or in a range between about 3:20 and about 1:5 in other embodiments. In some embodiments, a ratio between the front lower surface height D and the body height B can be about 1:5, or about 3:20 in other embodiments.

In some embodiments, a ratio between the front cutout depth K and the body thickness A can be in a range between about 1:10 and about 1:5, or in a range between about 2:25 and about 4:25 in other embodiments. In some embodiments, a ratio between the front cutout depth K and the body thickness A can be about 3:22, or about 3:25 in other embodiments.

In some embodiments, a ratio between the body thickness A and the cutout thickness J can be in a range between about 1:1 to about 2:1 in some embodiments, or in a range between about 1:1 and about 3:2 in other embodiments, or in a range between about 5:4 and about 3:2 in yet other embodiments. In some embodiments, a ratio between the body thickness A and the cutout thickness J can be at least about 3:2. In some embodiments, a ratio between the body thickness A and the cutout thickness J can be about 11:8, or about 5:4 in other embodiments.

In some embodiments, a ratio between the rear lower surface height F and the body height B can be in a range between about 1:10 and about 1:4, or about 3:20 and about 1:5 in other embodiments. In some embodiments, a ratio between the rear lower surface height F and the body height B can be about 1:5, or about 7:40 in other embodiments.

In some embodiments, a ratio between the top cutaway depth H and the body thickness A can be in a range between about 1:2 and about 1:1, and about 1:2 and about 3:5 in other embodiments. In some embodiments, a ratio between the top cutaway depth H and the cutout thickness J can be in a range between about 3:4 and about 1:1, and about 7:8 and about 1:1 in other embodiments, and about 13:16 and about 13:19 in other embodiments. In some embodiments, a ratio between the bottom cutaway depth I and the body thickness A can be in a range between about 3:4 and about 1:1, and about 7:8 and about 1:1 in other embodiments, and about 19:22 and about 22:25 in other embodiments.

Wear members having the dimensions described herein can help maximize wear member efficiency by increasing a wear members usable life while minimizing weight and materials to the extent possible. Various embodiments of the end cutting-bit 100, for example, have relatively narrow cutout thickness J as compared to the body depth A. Such depth and thickness ratios can minimize the material used make the wear members in the areas, such as the cutout regions, that are not as exposed to repetitive scraping and abrasions against a work surface. In contrast, the areas that are exposed to the work surface have increased thickness in order to increase wear life. In other words, many of the wear members disclosed herein, such as end cutting-bit 100 and cutting edge 800, maximize material in the regions needed most, such as the lower portion 108 of end-cutting bit 100, while minimizing materials in regions exposed to less abuse, such as the top portion 106 of end cutting-bit 100.

Figure 6:
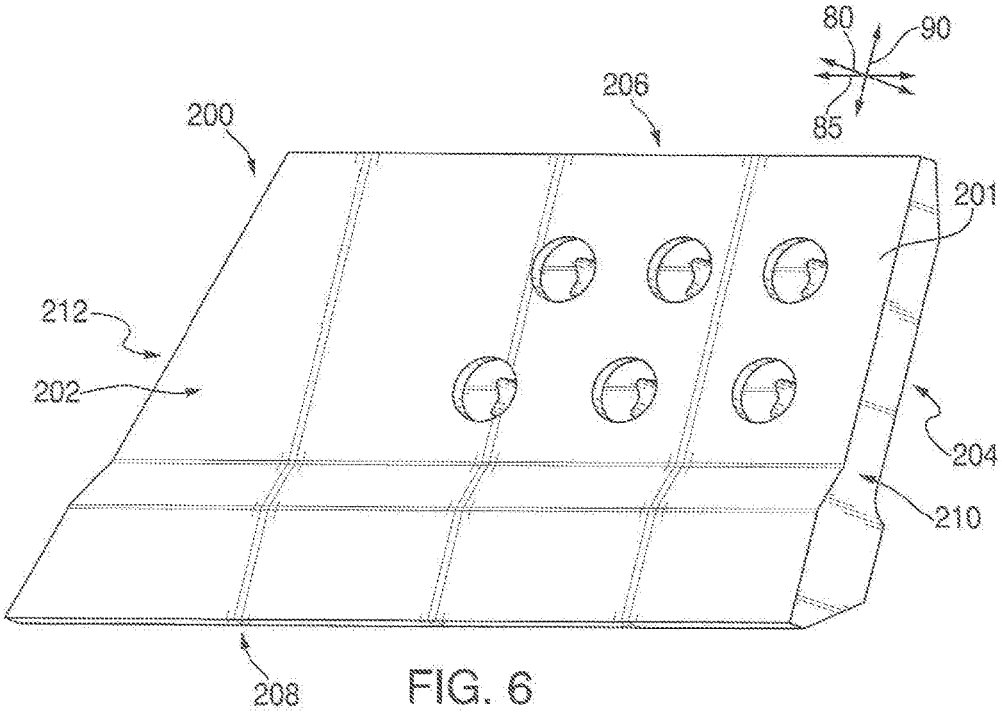
FIG. 6 is a front-right perspective view of another embodiment of a wear member constructed in accordance with the principles of the present disclosure.

FIG. 6 shows another embodiment of a wear member, specifically another end cutting-bit 200, that is substantially symmetrical to the end cutting-bit 100. The end cutting-bit 200 can be formed from a body 201 that can have a generally trapezoidal shape. The body 201 can have a front portion 202, a rear portion 204, a top portion 206, a bottom portion 208, an inner side portion 210, and an outer side portion 212. Although not every feature of end cutting-bit 100 is referenced on end cutting-bit 200 in FIG. 6, it should be understood that the end cutting-bit 200 includes similar features to those recited and shown in FIGS. 3-5 of end cutting-bit 100. Because end cutting-bit 200 is substantially symmetrical to the end cutting-bit 100, end cutting-bit 200 can be configured to be disposed on an end of an earth-working implement blade opposite the end cutting-bit 100.

Figure 7:
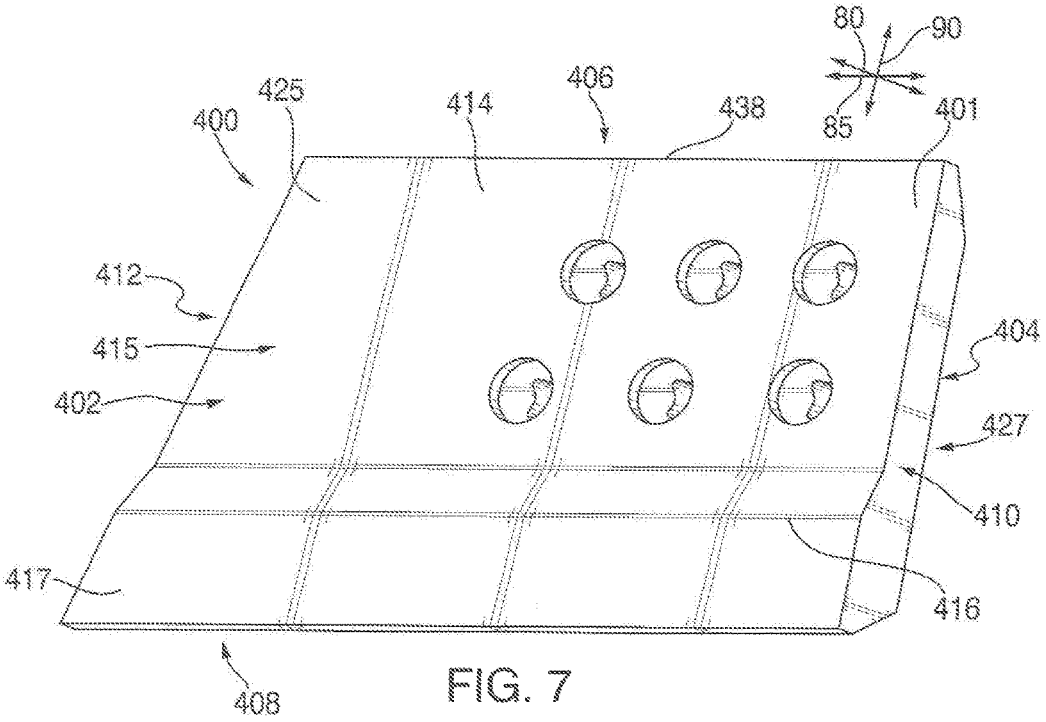
FIG. 7 is a front-right perspective view of another embodiment of a wear member constructed in accordance with the principles of the present disclosure.

FIG. 7 shows yet another embodiment of a wear member, specifically another embodiment of an end cutting-bit 400. End cutting-bit 400 can be formed from a body 401 that can have a generally trapezoidal shape. The body 401 can have a front portion 402, a rear portion 404, a top portion 406, a bottom portion 408, an inner side portion 410, and an outer side portion 412. The body 401 can include a front face 414 defined on the front portion 402. Similar to the end cutting-bit 100, the front face 414 forms a front cutout 415 delimited by a lower front cutout edge 416 and a front top edge 438. The front face 414 defines a front base cutout portion 425 and a front lower surface 417. Although not every feature of the front face 114 of end cutting-bit 100 is referenced on end cutting-bit 400 in FIG. 7, it should be understood that the front face 414 of end cutting-bit 400 includes similar features to those recited and shown in on the front face 114 in FIGS. 3-5 of end cutting-bit 100. Although the end cutting-bit 400 has a rear face 427 disposed on the rear portion 404, the end cutting-bit 400 is distinguishable from the end cutting-bit 100 and 200 because the end cutting-bit 400 does not include a rear cutout formed in the rear face. Instead, the rear face 427 can be substantially flat and substantially parallel to the front base cutout portion 425 of the front face 414.

Figure 8:
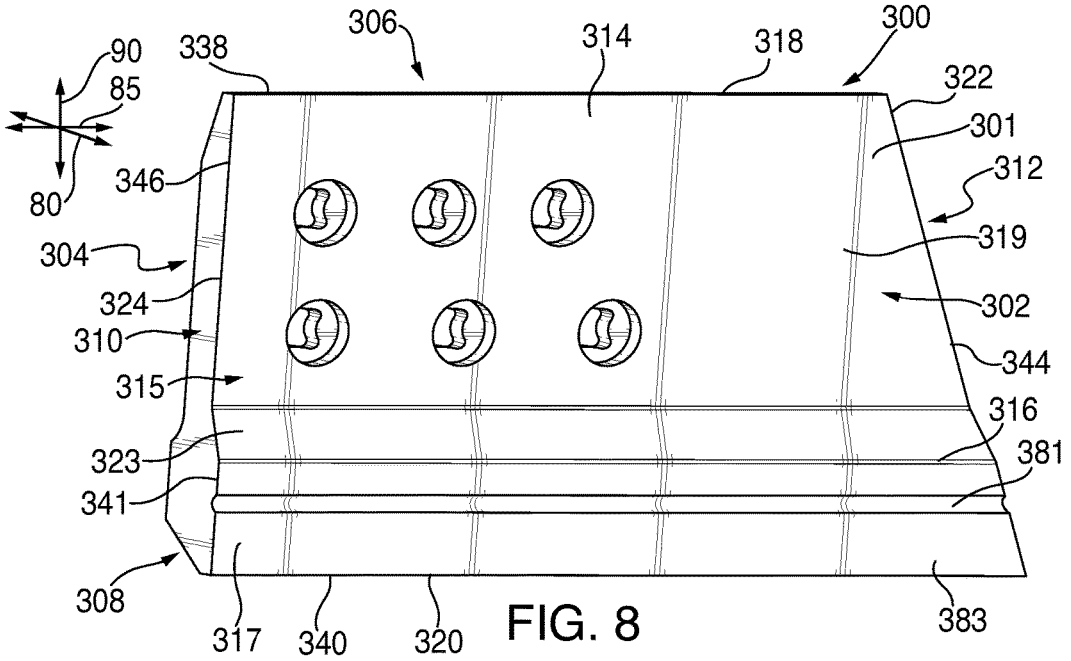
FIG. 8 is a front-left perspective view of the wear member of FIG. 3 including a lower wear indicator groove constructed in accordance with the principles of the present disclosure.
Figure 9:
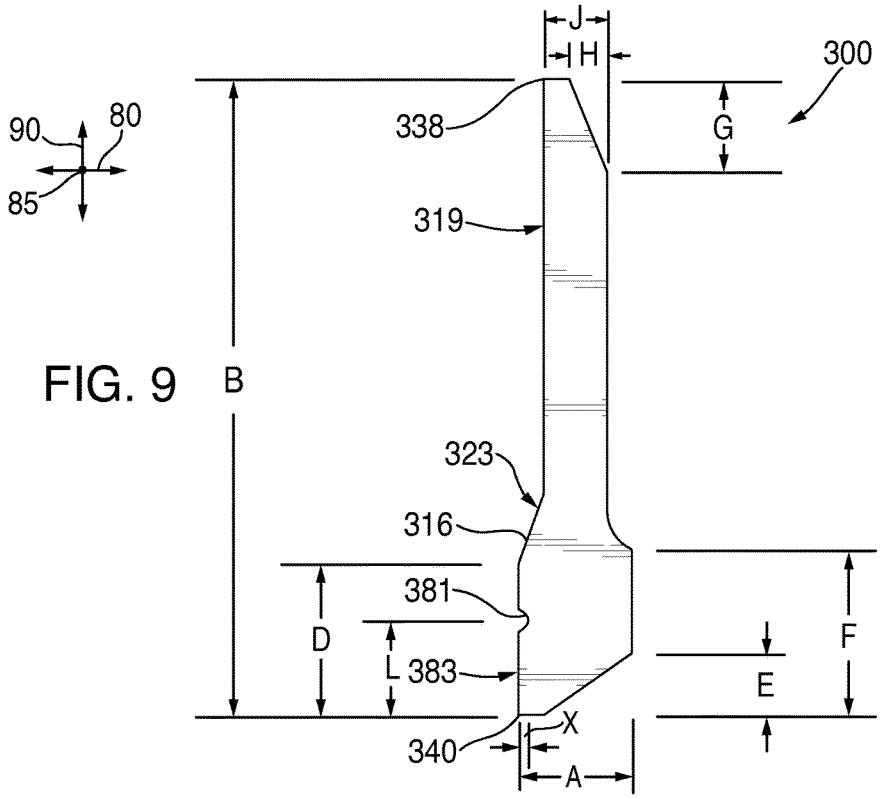
FIG. 9 is a right side view of the wear member of FIG. 8.

FIGS. 8-9 show another embodiment of a wear member, specifically another end cutting-bit 300. The end cutting-bit 300 is substantially similar to the end cutting-bit 100 shown in FIGS. 3-5, except that the end cutting-bit 300 includes a lower wear indicator groove 381 and a lower wear face 383. Although not every feature of end cutting-bit 100 is referenced on end cutting-bit 300 in FIGS. 8-9, it should be understood that, other than the lower wear indicator groove 381 and the lower wear face 383, the end cutting-bit 300 includes similar features to those recited and shown in FIGS. 3-5 with respect to end cutting-bit 100. Specifically, the end cutting-bit 300 can be formed from a body 301 that can have a generally trapezoidal shape. The body 301 can have a front portion 302, a rear portion 304, a top portion 306, a bottom portion 308, an inner side portion 310, and an outer side portion 312.

The body 301 can additionally include a front bottom edge 340 defined along at least a portion of a front bottom interface 320 between the front portion 302 and the bottom portion 308. The front bottom edge 340 is aligned with the longitudinal axis 85. A front top edge 338 can be defined along at least a portion of a front top interface 318 between the front portion 302 and the top portion 306. The front top edge 338 can be substantially parallel to the front bottom edge 340, or substantially aligned with the longitudinal axis 85. A front inner side edge 346 defined along at least a portion of a front inner side interface 324 between the inner side portion 310 and the front portion 302. A front outer side edge 344 can be defined along at least a portion of a front outer side interface 322 between the outer side portion 312 and the front portion 302. A front face 314 can be defined on the front portion 302. The front face 314 can extend between the front inner side edge 346, the front outer side edge 344, the front top edge 338, and the front bottom edge 340. A front lower cutout edge 316 can be disposed on the front face 314 between the front top edge 338 and the front bottom edge 340. The front lower cutout edge 316 can be substantially parallel to the front bottom edge 340. A front cutout 315 can be formed in the front face 314 and can be delimited by the front lower cutout edge 316 and the front top edge 338. A front lower surface 317 can be defined between the front lower cutout edge 316 and the front bottom edge 340. The front inner side edge 346 can include an inner lower front portion 341 defined adjacent the front lower surface 317 along the front inner side interface 324 between the inner side portion 310 and the front portion 302. Additionally, a front cutout surface 319 can be defined by the front cutout 315 between the front lower cutout edge 316 and the front top edge 338. The front cutout surface 319 can be offset from the front lower surface 317 in a direction along the normal axis 80. A front cutout transition surface 323 can be defined between the front lower surface 317 and the front cutout surface 319. In some embodiments, the front lower surface 317 can be substantially parallel to at least a portion of the front cutout surface 319.

In FIGS. 8-9, for the purposes of illustration, the body 301 of the end cutting-bit 300 is aligned such that the front bottom edge 340 is defined substantially along the longitudinal axis 85, and the inner lower front portion 341 is aligned with the lateral axis 90. A lower wear indicator groove 381 can be formed in the front face 314 substantially parallel to the front bottom edge 340. In some embodiments, the lower wear indicator groove 381 can be formed between the front bottom edge 340 and the front lower cutout edge 316. Although FIGS. 8-9 illustrate the lower wear indicator groove 381 as having a rounded, soft profile, other profile shapes, such as wedges or other angles, are also contemplated. A lower wear face 383 can be defined between the front bottom edge 340 and the lower wear indicator groove 381. As shown in FIG. 9, a lower wear indicator height L can be measured along the lateral axis 90 between the front bottom edge 340 and the lower wear indicator groove 381. A wear indicator depth X can be measured along the normal axis 90 between the front bottom edge 340 and the back surface of the lower wear indicator groove 381. In some embodiments, a ratio between the lower wear indicator height L and the body height B, measured along the lateral axis between the front bottom edge 340 and the front top edge 338, can be in a range between about 1:20 and about 1:5, or in a range between about 1:10 and about 3:25 in other embodiments. In some embodiments, a ratio between the lower wear indicator height L and the body height B, measured along the lateral axis between the front bottom edge 340 and the front top edge 338, can be at least about 1:10. In some embodiments, a ratio between the lower wear indicator height L and the body height B, measured along the lateral axis between the front bottom edge 340 and the front top edge 338, can be about 13:100, or about 1:10 in other embodiments. In some embodiments, a ratio between the wear indicator depth X and the body thickness A can be in a range between about 1:20 and about 2:5, or in a range between about 1:10 and about 1:5 in other embodiments, or in a range between about 1:8 and about 1:6 in other embodiments. In some embodiments, a ratio between the wear indicator depth X and the body thickness A can be about 13:100, or about 4:25 in other embodiments.

A wear indicator groove, such as the lower wear indicator groove 381, can serve an important function in determining when the end cutting-bit 300 needs to be replaced with a new end cutting-bit or other wear member. In embodiments featuring the lower wear indicator groove 381 such as in FIGS. 8-9, the body 301 can be configured to be mounted to an earth-working implement so as to dispose the lower wear face 383 between a mounting edge of the earth-working blade and a work surface, such as the ground. As the earth-working implement, such as the blade 66 shown in FIG. 3, equipped with the end cutting-bit 300 is used, the bottom portion 308 can gradually wear away against the work surface. When the body 301 is mounted on the earth-working implement such that the lower wear face 383 is disposed between the mounting edge of the blade and the work surface, an operator or other observer can easily visually observe when the bottom portion 308 has worn away the entire lower wear face 383 up to the lower indicator groove 381. Since the lower wear face 383 is mounted below the mounting edge with respect to the work surface, the mounting edge is not damaged by the work surface, which would result in costly repairs to the earth-working implement. Using a visually observable wear indicator groove, such as that described herein, can help increase work efficiency by providing an easy way to determine when to change wear members without the need to do a more detailed investigation as to the level of wear on the wear member. Additionally, in certain operation modes, the front face 314 can undergo significant abrasive contact with work material, such as stones, rocks, dirt, or other material. In such operation modes, the material on the front portion 302 of the body 301 can wear away, deteriorating the front face 314. At some point when enough of the body 301 has worn away, a wear indicator groove, such as lower wear indicator groove 381, will no longer be distinguishable from the front face 314. At this point, an operator or another observer can recognize that that wear indicator is no longer visible and make a determination whether to replace the wear member 300.

Figure 10:
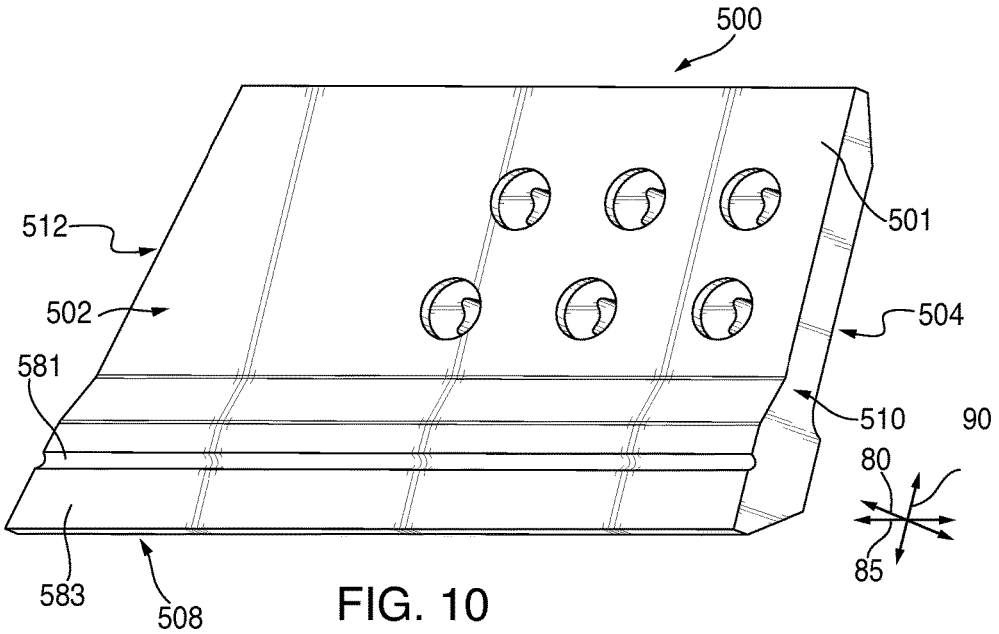
FIG. 10 is a front-right perspective view of another embodiment of a wear member having a lower wear indicator groove constructed in accordance with the principles of the present disclosure.

FIG. 10 shows another embodiment of a wear member, specifically another end cutting-bit 500, that is substantially symmetrical to the end cutting-bit 300. The end cutting-bit 500 can be formed from a body 501 that can have a generally trapezoidal shape. The body 501 can have a front portion 502, a rear portion 504, a top portion 506, a bottom portion 508, an inner side portion 510, and an outer side portion 512. Although not every feature of end cutting-bit 300 is referenced on end cutting-bit 500 in FIG. 10, it should be understood that the end cutting-bit 500 includes similar features to those recited and shown in FIGS. 3-5 of end cutting-bit 100 and in FIGS. 8-9 of end cutting-bit 300, including a lower wear indicator groove 581 and a lower wear face 583. Because end cutting-bit 500 is substantially symmetrical to the end cutting-bit 300, end cutting-bit 500 can be configured to be disposed on an end of an earth-working implement blade opposite the end cutting-bit 300.

Figure 11:
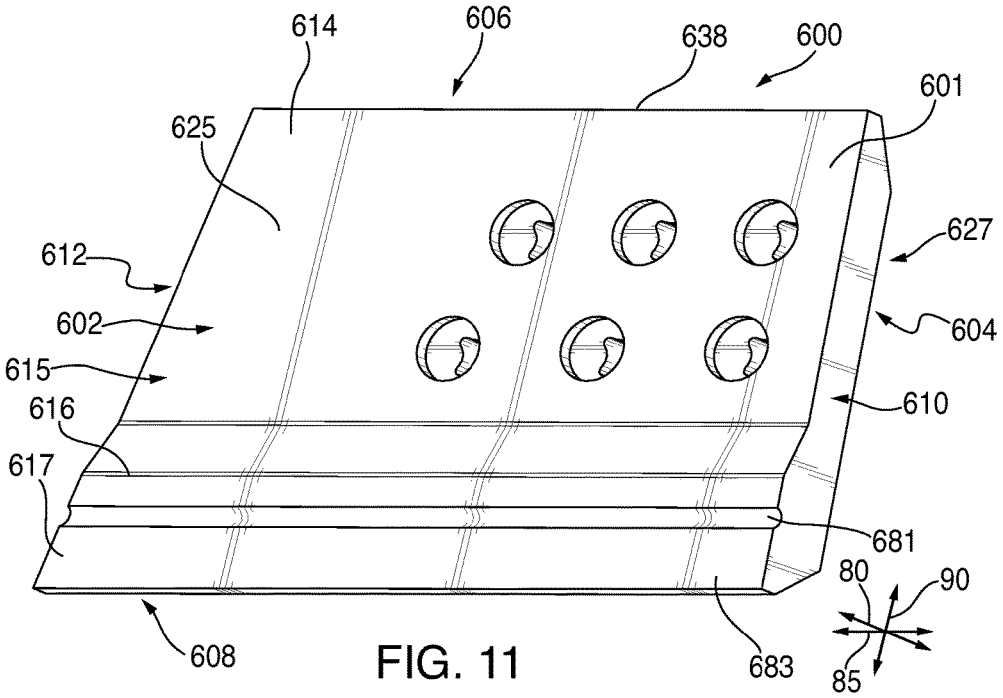
FIG. 11 is a front-right perspective view of another embodiment of a wear member having a lower wear indicator groove constructed in accordance with the principles of the present disclosure.

FIG. 11 shows yet another embodiment of a wear member, specifically another embodiment of an end cutting-bit 600. End cutting-bit 600 can be formed from a body 601 that can have a generally trapezoidal shape. The body 601 can have a front portion 602, a rear portion 604, a top portion 606, a bottom portion 608, an inner side portion 610, and an outer side portion 612. The body 601 can include a front face 614 defined on the front portion 602. Similar to the end cutting-bit 300, the front face 614 forms a front cutout 615 delimited by a lower front cutout edge 616 and a front top edge 638. The front face 614 defines a front base cutout portion 625 and a front lower surface 617. Also similar to end cutting-bit 300, the front face 614 can include a lower wear indicator groove 681 and a lower wear face 683. Although not every feature of the front face 314 of end cutting-bit 300 is referenced on end cutting-bit 600 in FIG. 11, it should be understood that the front face 614 of end cutting-bit 600 includes similar features to those referenced and shown in on the front face 314 in FIGS. 8-9 of end cutting-bit 300. Although the end cutting-bit 600 has a rear face 627 disposed on the rear portion 604, the end cutting-bit 600 is distinguishable from the end cutting-bit 300 and 200 for at least the reason because the end cutting-bit 600 does not include a rear cutout formed in the rear face. Instead, the rear face 627 can be substantially flat and substantially parallel to the front base cutout portion 625 of the front face 614.

Figure 23:
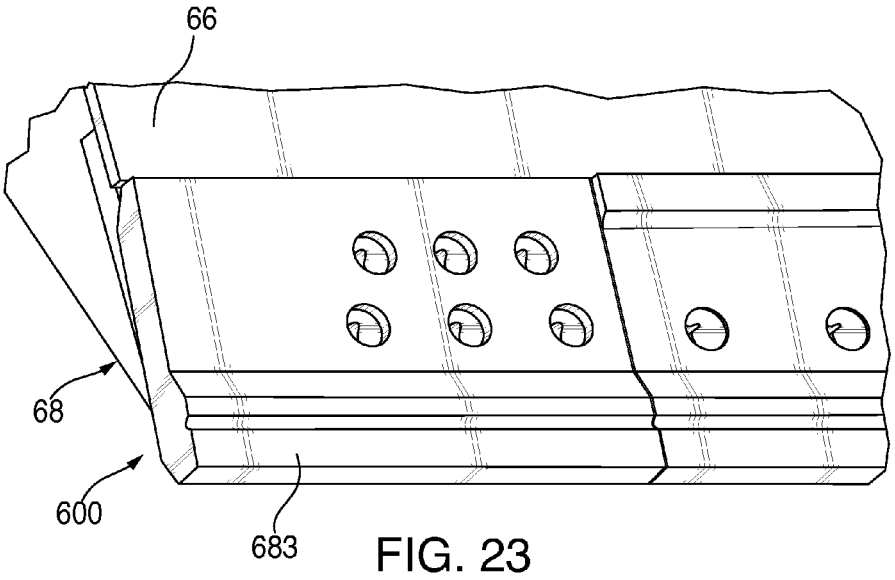
FIG. 23 is a partial front-left perspective view of the wear member of FIG. 11 mounted to an earth-working implement in accordance with the principles of the present disclosure.
Figure 24:
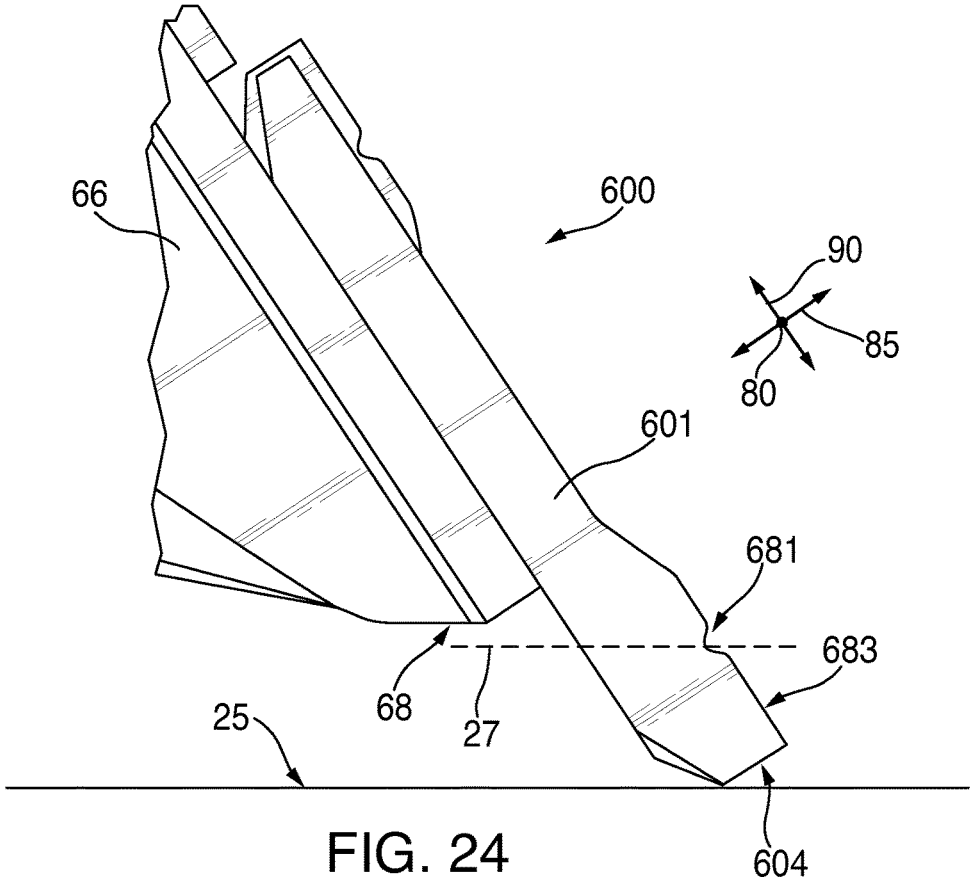
FIG. 24 is a partial left side view of the wear member of FIG. 23 engaging a work surface.

FIGS. 23-24 shows end cutting-bit 600 disposed on a mounting edge 68 of an earth-working implement, such as an earth-working blade 66. As shown in FIG. 24, the body 601 is mounted on the earth-working blade 66 such that the lower wear face 683 is disposed between the mounting edge 68 and a work surface 25, such as dirt, gravel, or any other suitable material. An imaginary work surface line 27 represents the work surface level at some point after the bottom portion 604 of the body 601 has been worn away by repeated contact with the work surface 25. As shown, the body 601 can be disposed such that, when work surface level reaches the level of the lower wear indicator groove 681, the mounting edge 68 of the earth-working blade 66 is still not in contact with the work surface. Thus, when an operator or other observer recognizes that the end cutting-bit 600 has been worn to the level of the lower wear indicator groove 683, the end cutting-bit 600 can be replaced without risk of damage to the earth-working implement. It should be understood that, although FIG. 24 illustrates end cutting-bit 600 with a lower wear indicator groove 681, it is contemplated that any of the wear member embodiments disclosed herein featuring any kind of wear indicator groove, such as end cutting-bits 300, 500, 700, and cutting edges 900, 1000, can be mounted on an earth-working implement such as is shown in FIG. 24 and with the same effective result.

Figure 12:
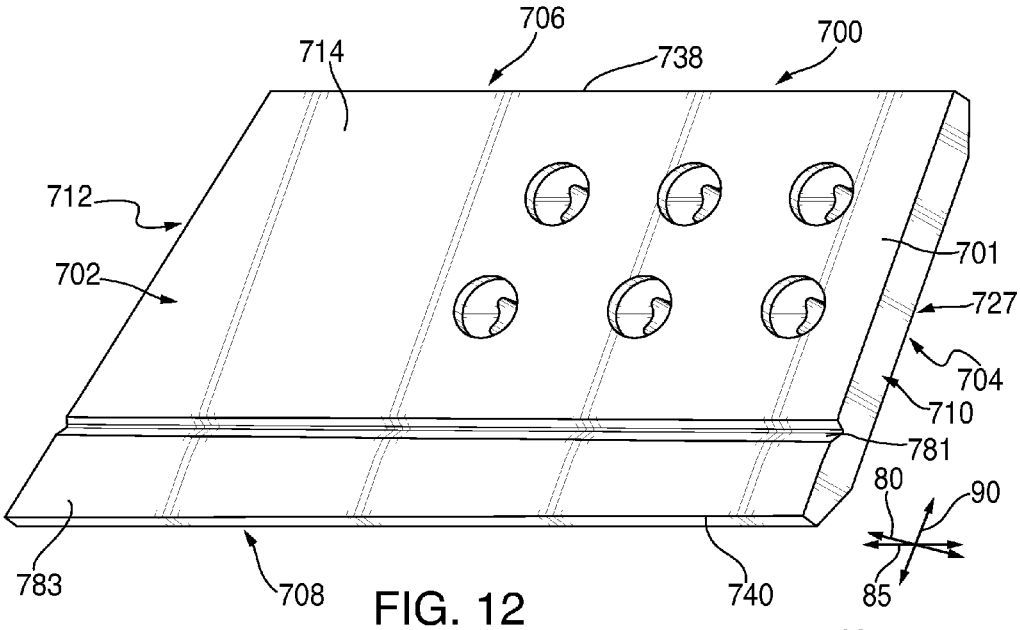
FIG. 12 is a front-right perspective view of another embodiment of a wear member constructed in accordance with the principles of the present disclosure.

FIG. 12 shows another embodiment of a wear member, specifically another embodiment of an end cutting-bit 700. End cutting-bit 700 can be formed from a body 701 that can have a generally trapezoidal shape. The body 701 can have a front portion 702, a rear portion 704, a top portion 706, a bottom portion 708, an inner side portion 710, and an outer side portion 712. The body 701 can include a front face 714 defined on the front portion 702 between a front top edge 738 and a front bottom edge 740. Similar to the end cutting-bit 300 in FIGS. 8-9, the front face 714 can include a lower wear indicator groove 781 disposed between the front bottom edge 740 and the front top edge 738. Additionally, the front face 714 includes a lower wear face 783 disposed between the front bottom edge 740 and the lower wear indicator groove 781. In some embodiments, the lower wear indicator groove 781 can be substantially parallel to the front bottom edge 740, but other non-parallel embodiments are also contemplated. Unlike the cutting end-bits 300, 500, the cutting end-bit 700 shown in FIG. 12 forms neither a front cutout nor a rear cutout. Instead, the front face 714 is substantially flat and can be substantially parallel to a rear face 727 formed on the rear portion 704. It should be understood that, although not specifically indicated in FIG. 12, the dimensions and ratios as related to the lower wear indicator groove 381 of FIGS. 8-9 can also apply to the lower wear indicator groove 781 illustrated in FIG. 12.

Figure 13:
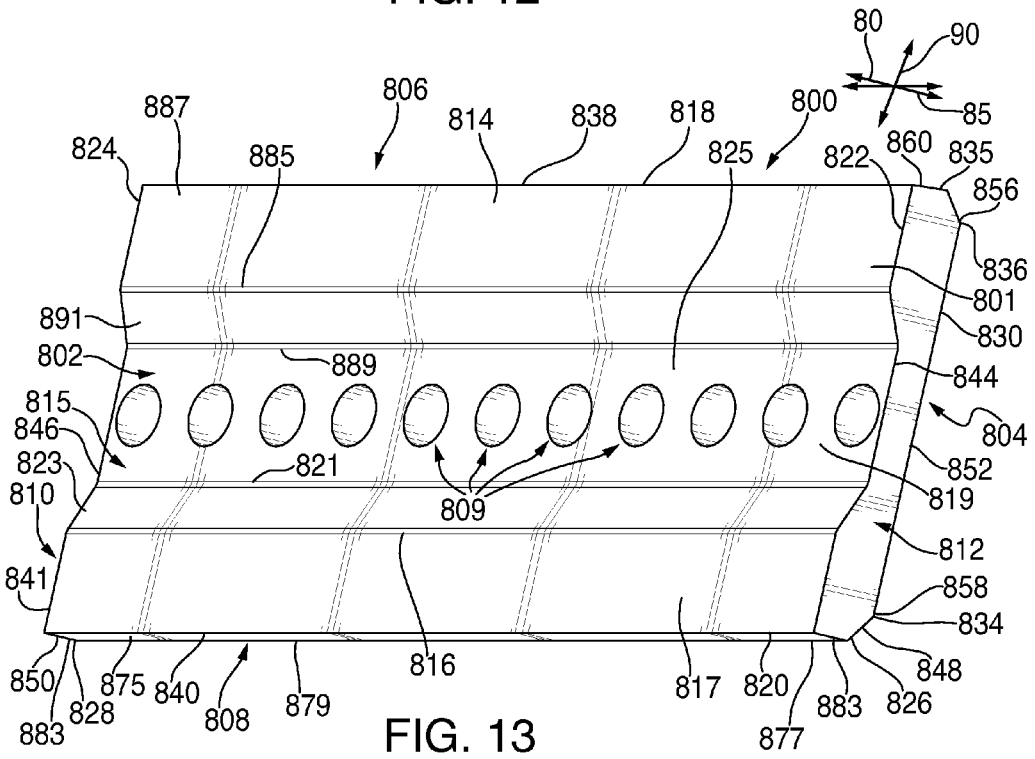
FIG. 13 is a front-right perspective view of another embodiment of a wear member constructed in accordance with the principles of the present disclosure.
Figure 14:
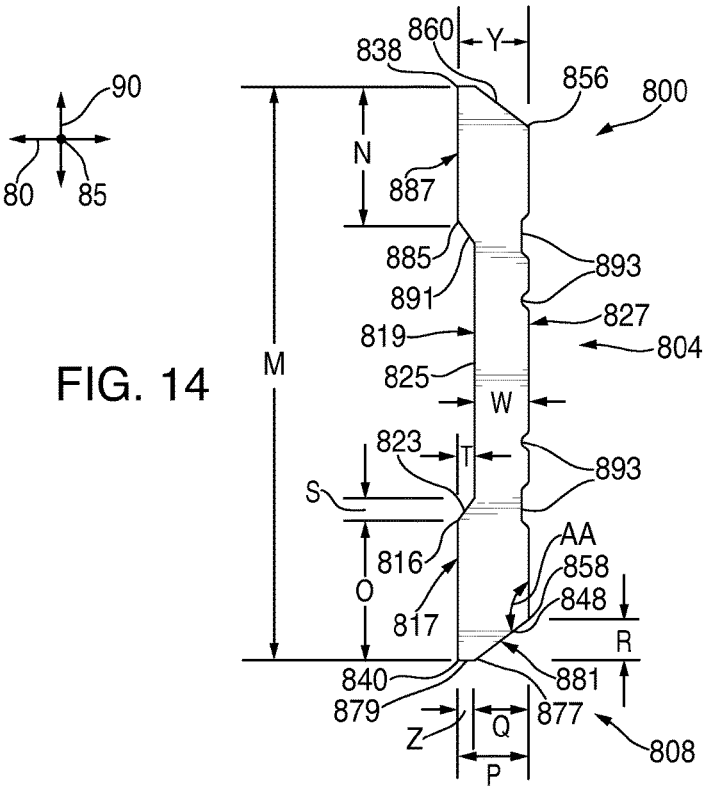
FIG. 14 is right side view of the wear member of FIG. 13.

FIGS. 13-14 illustrate views of another embodiment of a wear member, specifically a cutting edge 800. As will be discussed, the specific geometry of cutting edge 800 can provide for increased wear life and multiple use lives. Referring to FIGS. 13-14, the cutting edge 800 can be formed from a body 801 that can have a generally rectangular shape. The body 801 can have a front portion 802, a rear portion 804, a top portion 806, a bottom portion 808, an inner side portion 810, and an outer side portion 812. Interfaces can exist between each of the adjacent portions. Specifically, a front top interface 818 can exist between the top portion 806 and the front portion 802, and a front bottom interface 820 can exist between the front portion and the bottom portion 808. A front outer side interface 822 can exist between the front portion 802 and the outer side portion 812, and a front inner side interface 824 can exist between the front portion and the inner side portion 810. An outer bottom interface 826 can exist between the bottom portion 808 and the outer side portion 812, and an inner bottom interface 828 can exist between the inner side portion 810 and the bottom portion 808. Additionally, a rear outer side interface 830 can exist between the outer side portion 812 and the rear portion 804, and a rear inner side interface can exist between the inner side portion and the rear portion. A rear bottom interface 834 can exist between the rear portion 804 and the bottom portion 808, and a rear top interface 836 can exist between the top portion 806 and the rear portion. Finally, in some embodiments, an outer top interface 835 can exist between the outer side portion 812 and the top portion 806, and an inner top interface can exist between the inner side portion 810 and the top portion.

In some embodiments, a plurality of mounting orifices 809 can be formed in the body 801, creating passages between the front portion 802 and the rear portion 804 of the body. The mounting orifices 809 can be adapted to receive mounting hardware, such as bolts, screws, rivets, or other mounting tools suitable to secure the cutting edge 800 to an implement. In some embodiments, the mounting orifices 809 can be countersunk to provide a smooth, flush surface on the front portion 802. While the embodiment illustrated in FIG. 13 shows eleven mounting orifices 809 adapted to receive eleven sets of mounting hardware, it is contemplated that any number of mounting orifices can be used in other embodiments. It is also contemplated that alternative mounting methods can be used to mount the cutting edge 800 or other wear members to an earth-working blade or other implement.

The interfaces on the body 801 can define one or more edges that can define surfaces on the body. Specifically, a front top edge 838 can be disposed along the front top interface 818, and a front bottom edge 840 can be disposed along at least a portion of the bottom interface 820 between the inner side portion 810 and the outer side portion 812. A front outer side edge 844 can be disposed along the front outer side interface 822 between the front top edge 838 and the front bottom edge 840, and a front inner side edge 846 can be disposed along the front inner side interface 824 between the front top edge 838 and the front bottom edge 840. Additionally, the body 801 can include an outer bottom edge 848 disposed along the outer bottom interface 826 between the front bottom edge and the rear portion 804, and an inner bottom edge 850 disposed along the inner bottom interface 828 between the front bottom edge 840 and the rear portion. A rear outer side edge 852 can be disposed along the rear outer side interface 830 and extend between the top portion 806 and the outer bottom edge 848, and a rear inner side edge can be disposed along the rear inner side interface between the top portion and the inner bottom edge 850. A rear top edge 856 can be disposed along the rear top interface 836 and extend between the outer rear edge 852 and the inner rear edge, and a rear bottom edge 858 can be disposed along the rear bottom interface 834 between the outer rear edge and the inner rear edge. Further, in some embodiments, an outer top edge 860 can be defined along the outer top interface 835 between the front top edge 838 and the rear top edge 856, and an inner top edge can be defined along the inner top interface between the front top edge and the rear top edge. In some embodiments, the various edges can be chamfered to form rounded edges and corners to the body 801. It is contemplated, however, that the edges of the body 801 can have sharp corners, angled bevels, or any other suitable shape.

As best shown in FIGS. 13-14, the front portion 802 of the body 801 can define a front face 814. The front face 814 can extend between the front inner side edge 846, the front outer side edge 844, the front top edge 838, and the front bottom edge 840. The body 801 can be configured to be mounted to the mounting edge 68 of the earth-working implement 66 such that the front face 814 faces a direction away from the earth-working implement. The front face 814 can include a front upper cutout edge 885 and a front lower cutout edge 816. The front upper cutout edge 885 can be disposed between the front top edge 838 and the front bottom edge 840, and the front lower cutout edge 816 can be disposed between the front upper cutout edge 885 and the front bottom edge 840. In certain embodiments, the front lower cutout edge 816 can be substantially parallel to the front bottom edge 840 and the front upper cutout edge 885 can be substantially parallel to the front top edge 838, but other geometric orientations are contemplated. A front cutout 815 can be formed in the front face 814 and can be delimited by the front upper cutout edge 885 and the front lower cutout edge 816.

A front lower surface 817 can be defined on the front face 814 between the front bottom edge 840 and the front lower cutout edge 816, and a front upper surface 887 can be defined on the front surface 814 between the front upper cutout edge 885 and the front top edge 838. A front cutout surface 819 can be defined on the front face 814 by the front cutout 815 and extend between the front lower cutout edge 816 and the front upper cutout edge 885. In some embodiments, the front cutout surface 819 can be offset from the front lower surface 817 and the front upper surface 887 in a direction along the normal axis toward the rear portion 804. In some embodiments, the front upper surface and the front lower surface can be substantially co-planar.

The front inner side edge 846 can include an inner lower front portion 841 defined adjacent the front lower surface 817 along the front inner side interface 824 between the inner side portion 810 and the front portion 802. A lower transition seam 821 can be formed in the front face 814 between the front lower cutout edge 816 and the front upper cutout edge 885, and an upper transition seam 889 can be formed in the front face 814 between the lower transition seam 821 and the front upper cutout edge 885. The front cutout surface 819 can include a lower transition cutout portion 823 defined between the lower transition seam 821 and the front lower cutout edge 816, and an upper transition cutout portion 891 can be defined between the upper transition seam 889 and the front upper cutout edge 885. A front base cutout portion 825 can be defined between the upper transition seam 889 and the lower transition seam 821. Thus, in some embodiments, the front face 814 includes the front lower surface 817, the lower transition cutout portion 823 of the front cutout surface 819, the front base cutout portion 825 of the front cutout surface, the upper transition cutout portion 891, and the front upper surface 887. In certain embodiments, the front base cutout portion 825 can be substantially parallel to the front lower surface 817 and the front upper surface 887, and the upper and lower transition cutout portions 891, 823 can connect the front base cutout portion to the front upper and lower surfaces 887, 817, respectively, such that the front base cutout portion is offset from the front upper and lower surfaces in a direction toward the rear portion 804. However, other, non-parallel surface orientations are also contemplated.

The body 801 can also include a rear face 827 defined on the rear portion 804. The rear face 827 can extend between the rear inner side edge, the rear outer side edge 852, the rear top edge 856, and the rear bottom edge 858. In some embodiments, the rear face 827 can be substantially parallel to both the front lower surface 817 and the front upper surface 887, and in some embodiments, the rear face 827 can be substantially parallel to the front lower surface 817, the front upper surface 887, and the front base cutout portion 825 of the front cutout surface 819. In some embodiments, such as the cutting edge 800 illustrated in FIG. 14, at least one depression 893 can be formed in the rear face 827 and extend between the inner side portion 810 and the outer side portion 812. Although FIG. 14 shows four depressions 893, embodiments having other numbers of depressions, including zero, are also contemplated. The depressions 893 can be formed in the rear face 827 in order to minimize the weight and material used to form the body 801, but also ensure that adequate contact surface is available for the cutting edge 800 to engage an earth-working implement, particularly at the mounting edge. In some embodiments, the depressions 893 are disposed on the rear face 827 in such a way that the mounting orifices 809 used to house mounting hardware to mount the cutting edge 800 to the earth-working implement do not overlap with the depressions 893. The inner bottom edge 850 can include an inner bottom wear edge 883 defined along the inner bottom edge adjacent the bottom wear surface 879 and extending between the front bottom edge 840 and the bottom wear edge 877.

A bottom face 875 can be defined on the bottom portion 808. The bottom face 875 can extend between the front bottom edge 840, the rear bottom edge 858, the inner bottom edge 850, and the outer bottom edge 848. A bottom wear edge 877 can be disposed on the bottom face 875 between the front bottom edge 840 and the rear bottom edge 858. The bottom wear edge 877 can extend between the outer bottom edge 848 and the inner bottom edge 850 and can be substantially parallel to the front and rear bottom edges 840, 858. The bottom face 875 can bottom wear surface 879 that can be defined on the bottom face extending between the front bottom edge 840, the bottom wear edge 877, the outer bottom edge 848, and the inner bottom edge 850. The bottom face 875 can also include a bottom cutaway surface 881 that can be defined on the bottom face extending between the rear bottom edge 848, the bottom wear edge 877, the outer bottom edge 848, and the inner bottom edge 850.

In some embodiments, the body 801 can be configured to be mounted to a mounting edge 68 of the earth-working implement, such as earth-working blade 66 shown in FIG. 2, so as to selectively dispose either the bottom portion 808 of the body between the mounting edge and a work surface or the top portion 806 of the body between the mounting edge and the work surface. In other words, because the cutting edge 800 is substantially symmetrical, the cutting edge can be flipped from a first mounting position in which the bottom portion 808 is disposed to engage the work surface, to a second mounting position in which the top portion 806 is disposed to engage the work surface. This flexibility between mounting positions allows the cutting bit 800 to exhibit two wear lives, a first wear life, and a second wear life, increasing the efficiency and usefulness of each wear member.

In FIGS. 13-14, for the purposes of illustration, the body 801 of the cutting edge 800 is aligned such that the front bottom edge 840 is defined substantially along the longitudinal axis 85, and the inner lower front portion 841 is aligned with the lateral axis 90. The inner bottom wear edge 883 is aligned along the normal axis 80.

Referring now to FIG. 14, the following ratios between certain dimensional features of the wear member 800 are not meant to be exhaustive, but are merely examples of geometric ratios for dimensions of the wear member disclosed herein. The body 801 can have a body height M measured along the lateral axis 90 between the front bottom edge 840 and the front top edge 838. The front upper surface 887 can have a front upper surface height N measured along the lateral axis 90 between the front top edge 838 and the front upper cutout edge 885. The front lower surface 817 can have a front lower surface height O measured along the lateral axis 90 between the front bottom edge 840 and the front lower cutout edge 816. The body 801 can have a lower body thickness P that can be measured along the normal axis 80 between the front lower surface 817 and the rear face 827. The body 801 can have a cutaway depth Q that can be measured along the normal axis 80 between the bottom wear edge 877 and the rear bottom edge 858. The body can also have a cutaway height R that can be measured along the lateral axis 90 between the bottom wear edge 877 and the rear bottom edge 858. The lower transition cutout portion 823 can have a lower transition height S that can be measured along the lateral axis 90 between the front lower cutout edge 816 and the lower transition seam 821. The front cutout 815 can have a front cutout depth T that can be measured along the normal axis 80 between the front lower surface 817 and the cutout surface 819, specifically the front base cutout portion 825 of the cutout surface. The body 801 can also have a cutout thickness W that can be measured along the normal axis 80 between the front cutout surface 819, specifically the front base cutout portion 825, and the rear face 827. The body 801 can have an upper body thickness Y that can be measured along the normal axis 80 between the front upper surface 887 and the rear face 827. The bottom wear surface 879 can have a bottom wear edge depth Z that can be measured along the normal axis 80 between the front face 814 and the bottom wear edge 877.

In some embodiments, a ratio between the front lower surface height O and the body height M can be in a range between about 1:10 and about 3:10, and in a range between about 1:5 and about 1:4 in other embodiments. In some embodiments, a ratio between the front lower surface height O and the body height M can be at most about 3:10, or at most about 1:4 in other embodiments. In some embodiments, a ratio between the front lower surface height O and the body height M can be about 1:5, or about 1:4 in other embodiments.

In some embodiments, a ratio between the lower body thickness P and the cutout thickness W can be in a range between about 1:1 and about 3:2, or in a range between about 1:1 and about 5:4 in other embodiments, and in a range between about 1:1 and about 22:19 and about 19:16 in other embodiments. In other embodiments, a ratio between the lower body thickness P and the cutout thickness W can be at least about 1:1, or at least about 11:10 in other embodiments. In other embodiments, a ratio between the lower body thickness P and the cutout thickness W can be about 19:16, or about 22:19 in other embodiments.

In some embodiments, a ratio between the upper body thickness Y and the cutout thickness W can be in a range between about 1:1 and about 3:2, or in a range between about 1:1 and about 5:4 in other embodiments, and in a range between about 1:1 and about 22:19 and about 19:16 in other embodiments. In other embodiments, a ratio between the upper body thickness Y and the cutout thickness W can be at least about 1:1, or at least about 11:10 in other embodiments. In other embodiments, a ratio between the upper body thickness Y and the cutout thickness W can be about 19:16, or about 22:19 in other embodiments. In some embodiments, the upper body thickness Y can be substantially equal to the lower body thickness P.

In some embodiments, a ratio between the front cutout depth T and the lower body thickness P can be in a range between about 0:1 and about 3:10, or in a range between about 1:10 and about 1:5 in other embodiments, or in a range between about 3:19 and about 3:22 in other embodiments. In some embodiments, a ratio between the front cutout depth T and the lower body thickness P can be at least about 1:10. In some embodiments, a ratio between the front cutout depth T and the lower body thickness P can be about 3:19, and about 3:22 in other embodiments.

In some embodiments, a ratio between the bottom wear edge depth Z and the lower body thickness P can be in a range between about 0:1 and about 3:10, or in a range between about 1:10 and about 1:5 in other embodiments, or in a range between about 3:19 and about 3:22 in other embodiments. In some embodiments, a ratio between the bottom wear edge depth Z and the lower body thickness P can be at most about 1:5, or at most about 3:20 in other embodiments. In some embodiments, a ratio between the bottom wear edge depth Z and the lower body thickness P can be about 3:19, and about 3:22 in other embodiments.

In some embodiments, a ratio between the cutaway height R and the cutaway depth Q can be in a range between about 1:2 and about 1:1, or in a range between about 1:2 and about 2:3 in other embodiments, or in a range between about 11:16 and about 11:19 in other embodiments. In some embodiments, a ratio between the cutaway height R and the cutaway depth Q can be at least most about 3:5, and at most about 2:3 in other embodiments. In some embodiments, a ratio between the cutaway height R and the cutaway depth Q can be about 11:16, or about 11:19 in other embodiments.

It should be understood that, where applicable, the dimensional geometric ratios describes herein with respect to the cutting edge 800 can be applied to any of the other wear member embodiments disclosed herein. For example, although the end cutting-bit 300 shown in FIGS. 8-9 does not explicitly illustrate a cutaway height R or a cutaway depth Q, it should be understood that the like features of the end cutting-bit 300 could also have the disclosed geometrical relationships and ratios.

Figure 15:
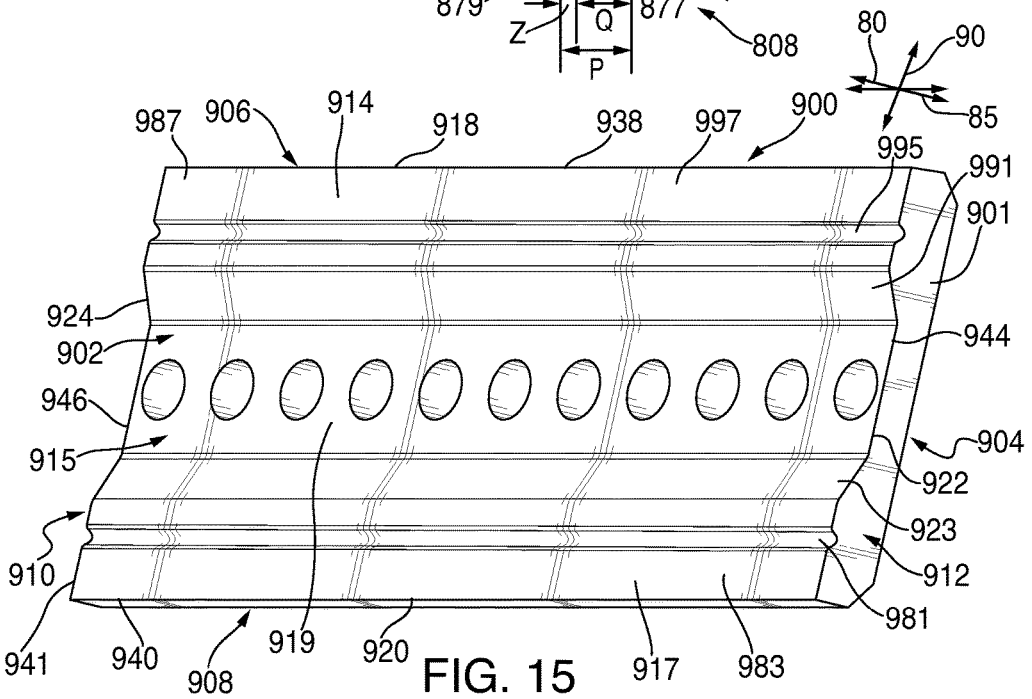
FIG. 15 is a front-right perspective view of an embodiment of a wear member having a lower wear indicator groove and an upper wear indicator groove constructed in accordance with the principles of the present disclosure.
Figure 16:
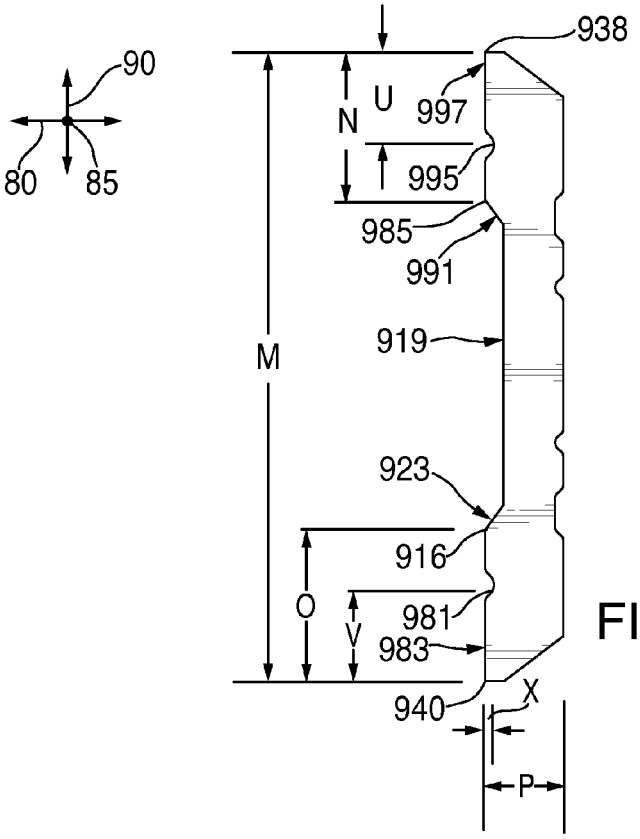
FIG. 16 is right side view of the wear member of FIG. 15.

FIGS. 15-16 show another embodiment of a wear member, specifically another cutting edge 900. The cutting edge 900 is substantially similar to the cutting edge 800 shown in FIGS. 13-14, except that the cutting edge 900 can additionally include a lower wear indicator groove 981 and a lower wear face 983, as well as an upper wear indicator groove 995 and an upper wear face 997. The cutting edge 900 can be formed from a body 901 that can have a generally rectangular shape. Although not every feature of the cutting edge 800 is referenced on the cutting edge 900 in FIGS. 15-16, it should be understood that, other than the upper and lower wear indicator grooves 995, 981 and the upper and lower wear faces 997, 983, the cutting edge 900 includes similar features to those recited and shown in FIGS. 13-14 with respect to cutting edge 800. Additionally, the body 901 of cutting edge 900 can include a lower wear indicator groove 981 and a lower wear face 983, as well as an upper wear indicator groove 995 and an upper wear face 997. Specifically, the cutting edge 900 can be formed from a body 901 that can have a generally rectangular shape. The body 901 can have a front portion 902, a rear portion 904, a top portion 906, a bottom portion 908, an inner side portion 910, and an outer side portion 912.

The body 901 can additionally include a front bottom edge 940 defined along at least a portion of a front bottom interface 920 between the front portion 902 and the bottom portion 908. The front bottom edge 940 is aligned with the longitudinal axis 85. A front top edge 938 can be defined along at least a portion of a front top interface 918 between the front portion 902 and the top portion 906. The front top edge 938 can be substantially parallel to the front bottom edge 940, or substantially aligned with the longitudinal axis 85. A front inner side edge 946 defined along at least a portion of a front inner side interface 924 between the inner side portion 910 and the front portion 902. A front outer side edge 944 can be defined along at least a portion of a front outer side interface 922 between the outer side portion 912 and the front portion 902. A front face 914 can be defined on the front portion 902. The front face 914 can extend between the front inner side edge 946, the front outer side edge 944, the front top edge 938, and the front bottom edge 940. A front lower cutout edge 916 can be disposed on the front face 914 between the front top edge 938 and the front bottom edge 940. The front lower cutout edge 916 can be substantially parallel to the front bottom edge 940. A front upper cutout edge 985 can be disposed on the front surface 914 between the front top edge 938 and the front lower cutout edge 916. The front upper cutout edge 985 can be substantially parallel to the front top edge 938. A front cutout 915 can be formed in the front face 914 and can be delimited by the front lower cutout edge 916 and the front upper cutout edge 985. A front lower surface 917 can be defined between the front lower cutout edge 916 and the front bottom edge 940, and a front upper surface 987 can be defined between the front upper cutout edge 985 and the front top edge 938. The front inner side edge 946 can include an inner lower front portion 941 defined adjacent the front lower surface 917 along the front inner side interface 924 between the inner side portion 910 and the front portion 902. Additionally, a front cutout surface 919 can be defined by the front cutout 915 between the front lower cutout edge 916 and the front upper cutout edge 938. The front cutout surface 919 can be offset from the front lower surface 917 and from the front upper surface 987 in a direction along the normal axis 80 toward the rear portion 904. A lower transition cutout portion 923 can be defined between the front lower surface 917 and the front cutout surface 919, and an upper transition cutout portion 991 can be defined between the front upper surface 987 and the front cutout surface. In some embodiments, the front lower surface 917 and the front upper surface 987 can both be substantially parallel to at least a portion of the front cutout surface 919. In some embodiments, the front lower surface 917 and the front upper surface 987 can be co-planar.

In FIGS. 15-16, for the purposes of illustration, the body 901 of the cutting edge 900 is aligned such that the front bottom edge 940 is defined substantially along the longitudinal axis 85, and the inner lower front portion 941 is aligned with the lateral axis 90. A lower wear indicator groove 981 can be formed in the front face 914 substantially parallel to the front bottom edge 940. In some embodiments, the lower wear indicator groove 981 can be formed between the front bottom edge 940 and the front lower cutout edge 916. An upper wear indicator groove 995 can be formed in the front face 914 substantially parallel to the front top edge 938. In some embodiments, the upper wear indicator groove 995 can be formed between the front top edge 938 and the front upper cutout edge 985. Although FIGS. 15-16 illustrate the upper and lower wear indicator grooves 995, 981 as having rounded, soft profiles, other profile shapes, such as wedges or other angles, are also contemplated. A lower wear face 983 can be defined between the front bottom edge 940 and the lower wear indicator groove 981, and an upper wear face 997 can be defined between the front top edge 938 and the upper wear indicator groove 995.

As shown in FIG. 16, a lower wear indicator height V can be measured along the lateral axis 90 between the front bottom edge 940 and the lower wear indicator groove 981, and an upper wear indicator height U can be measured along the lateral axis 90 between the front top edge 938 and the upper wear indicator groove 995. In some embodiments, the upper wear indicator height U is substantially equal to the lower wear indicator height V. The upper and lower wear indicator grooves 981, 995 can have a wear indicator depth X that is substantially similar to the depth of lower wear indicator groove 381 described above. The wear indicator depth X can be measured along the normal axis 90 between the front bottom edge 940 and the back surface of the lower wear indicator groove 981 or upper wear indicator groove 995.

In some embodiments, a ratio between the lower wear indicator height V and the body height M, measured along the lateral axis between the front bottom edge 940 and the front top edge 938, can be in a range between about 1:20 and about 1:5, or in a range between about 1:10 and about 3:25 in other embodiments. In some embodiments, a ratio between the lower wear indicator height V and the body height M, measured along the lateral axis between the front bottom edge 940 and the front top edge 938, can be at least about 1:10. In some embodiments, a ratio between the lower wear indicator height V and the body height M, measured along the lateral axis between the front bottom edge 940 and the front top edge 938, can be about 13:100, or about 1:10 in other embodiments. In some embodiments, a ratio between the wear indicator depth X and the body thickness P can be in a range between about 1:20 and about 2:5, or in a range between about 1:10 and about 1:5 in other embodiments, or in a range between about 1:8 and about 1:6 in other embodiments. In some embodiments, a ratio between the wear indicator depth X and the body thickness P can be about 13:100, or about 4:25 in other embodiments.

In some embodiments, a ratio between the upper wear indicator height U and the body height M, measured along the lateral axis between the front bottom edge 940 and the front top edge 938, can be in a range between about 1:20 and about 1:5, or in a range between about 1:10 and about 3:25 in other embodiments. In some embodiments, a ratio between the upper wear indicator height U and the body height M, measured along the lateral axis between the front bottom edge 940 and the front top edge 938, can be at least about 1:10. In some embodiments, a ratio between the upper wear indicator height U and the body height M, measured along the lateral axis between the front bottom edge 940 and the front top edge 938, can be about 13:100, or about 1:10 in other embodiments.

In some embodiments, the body 900 can be configured to be mounted to an earth-working implement, such as earth-working blade 66 shown in FIG. 2, so as to selectively dispose either the bottom portion 908 of the body between the mounting edge and a work surface or the top portion 906 of the body between the mounting edge and the work surface. In other words, because the cutting edge 900 is substantially symmetrical, the cutting edge can be flipped from a first mounting position in which the bottom portion 908 is disposed to engage the work surface, to a second mounting position in which the top portion 906 is disposed to engage the work surface. This flexibility between mounting positions allows the cutting bit 900 to exhibit two wear lives, a first wear life, and a second wear life, increasing the efficiency and usefulness of each wear member. An example of the multiple wear lives available to the cutting edge 900 is illustrated in FIGS. 17-18.

Figure 17:
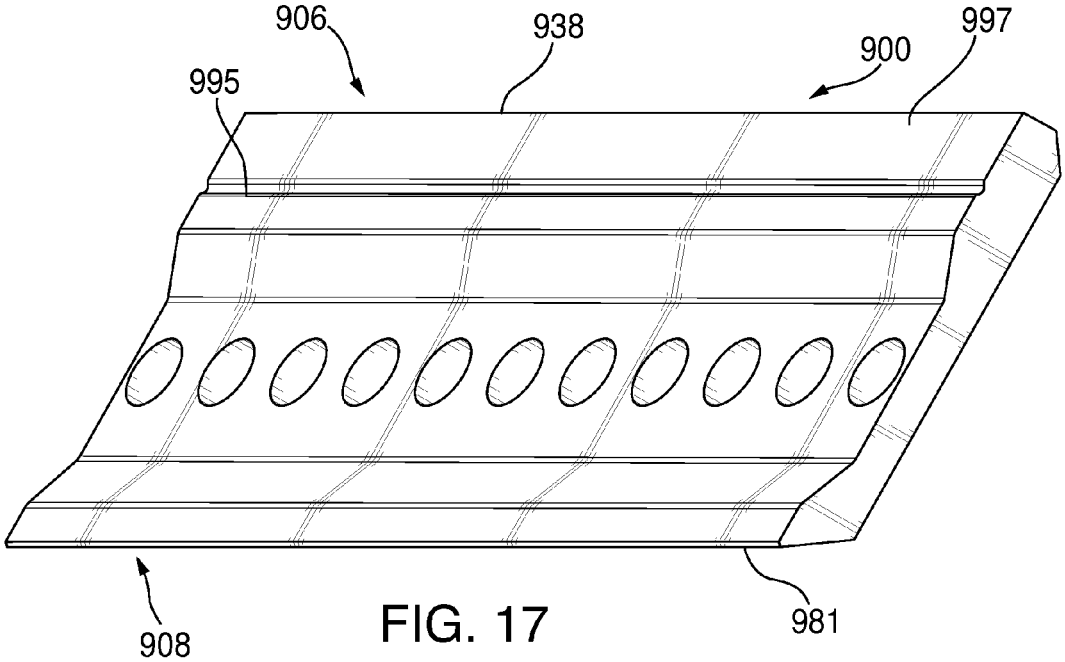
FIG. 17 is a front-right perspective view of the wear member of FIG. 15 after a first wear member life.
Figure 18:
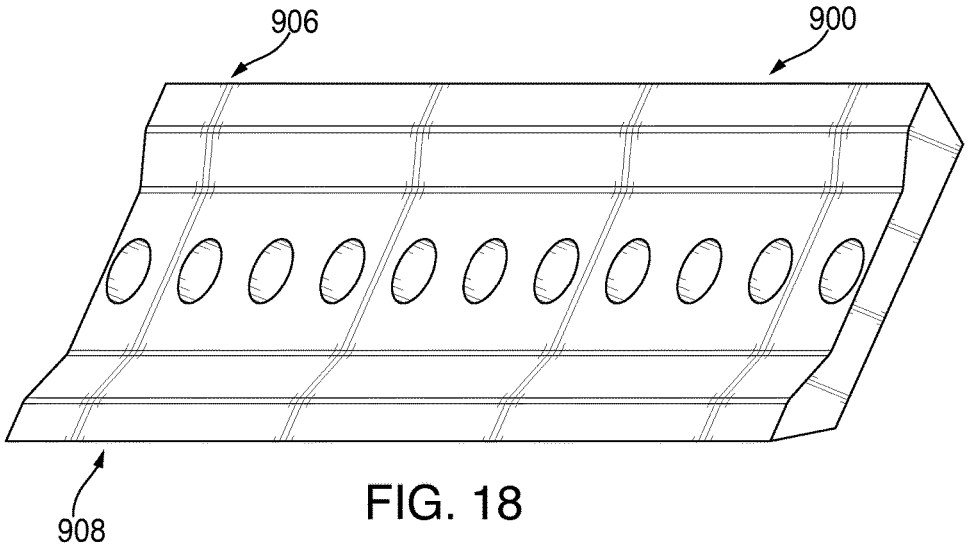
FIG. 18 is a front-right perspective view of the wear member of FIG. 15 after a second wear member life.

FIG. 17 shows cutting edge 900 after a first life during which the body 901 can be mounted to an earth-working implement such that the lower portion 908 can be disposed to engage a work surface. Eventually, after repetitive use of the cutting edge 900, the bottom portion 908 can be worn such that the entire lower wear face 983 is worn way and the work surface is even with the lower wear indicator groove 981. Upon observing the level of wear illustrated in FIG. 17, an operator or other observer can stop operation in order to flip the cutting edge 900 to begin a second life. During the second life, the body 901 can be mounted on the earth-working implement so as to dispose the top portion 906 of the body 901 to engage the work surface. FIG. 18 illustrates cutting edge 900 after the second life. As illustrated, both the top portion 906 and the bottom portion 908 are worn away to the point where nothing is left of either the lower wear face 983 or the upper wear face 997. When an operator or other observer determines that a wear member such as cutting edge 900 has completed its second life, the fully worn wear member can be removed from the earth-working implement and replaced with a new cutting edge or other wear member so as to prevent damage to the earth-working implement.

Figure 19:
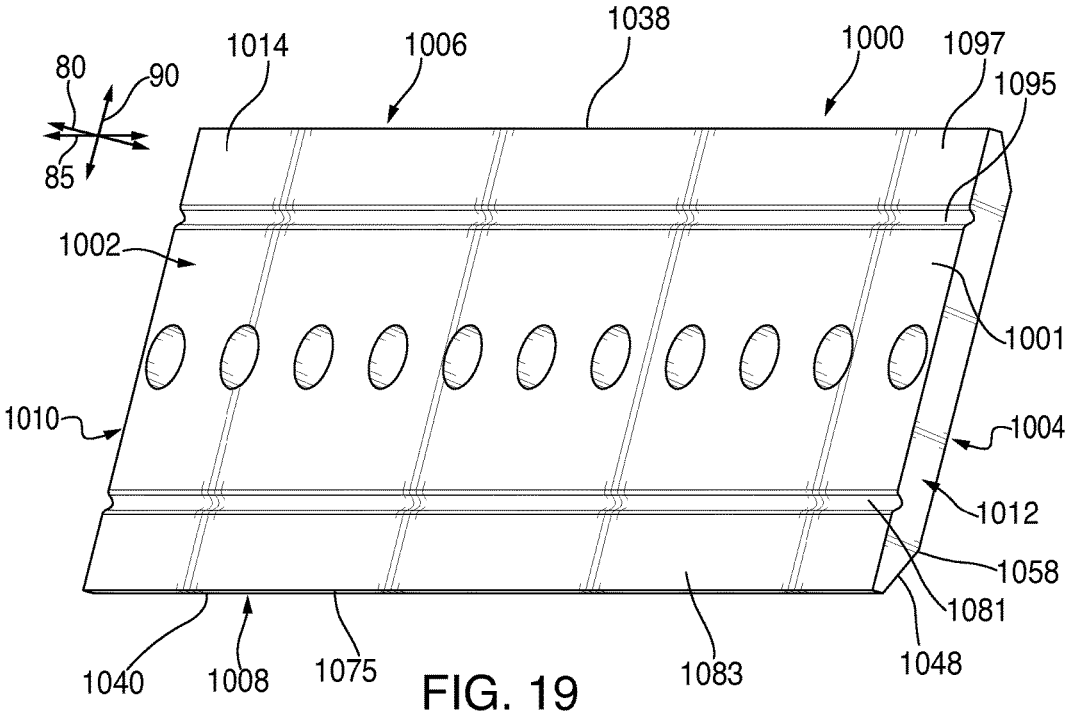
FIG. 19 is a front-right perspective view of another embodiment of a wear member having a lower wear indicator groove and an upper wear indicator groove constructed in accordance with the principles of the present disclosure.
Figure 20:
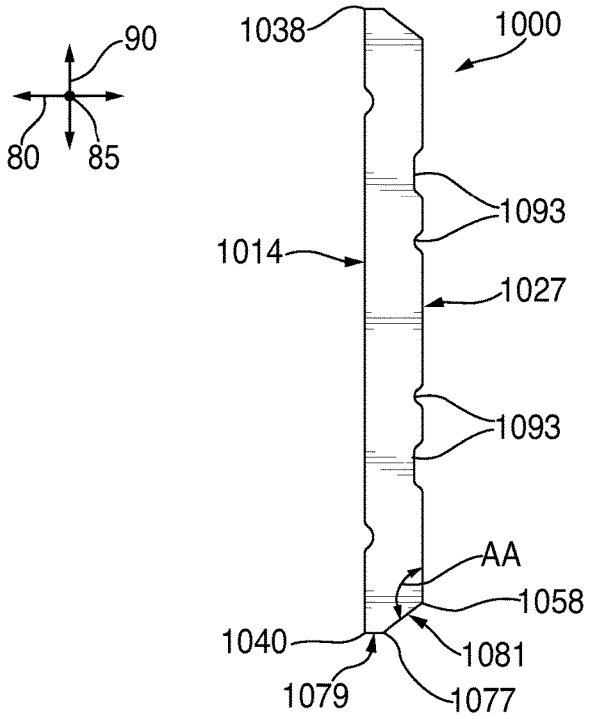
FIG. 20 is a right side view of the wear member of FIG. 19.

FIGS. 19-20 show another embodiment of a wear member, specifically another embodiment of a cutting edge 1000. The cutting edge 1000 can be formed from a body 1001 that can have a generally rectangular shape. The body 1001 can have a front portion 1002, a rear portion 1004, a top portion 1006, a bottom portion 1008, an inner side portion 1010, and an outer side portion 1012. The body 1001 can include a front face 1014 defined on the front portion 1002 between a front top edge 1038 and a front bottom edge 1040. Similar to the cutting edge 900 in FIGS. 15-16, the front face 1014 can include a lower wear indicator groove 1081 disposed between the front bottom edge 1040 and the front top edge 1038, and an upper wear indicator groove 1095 disposed between the front top edge 1038 and the lower wear indicator groove. Additionally, the front face 1014 includes a lower wear face 1083 disposed between the front bottom edge 1040 and the lower wear indicator groove 1081, and an upper wear face 1097 disposed between the front top edge 1038 and the upper wear indicator groove 1095. In some embodiments, the lower wear indicator groove 1081 can be substantially parallel to the front bottom edge 1040 and the upper wear indicator groove 1095 can be substantially parallel to the front top edge 1038, but other non-parallel embodiments are also contemplated. Unlike the cutting edges 800, 900, the cutting edge 1000 shown in FIGS. 19-20 has no front cutouts. Instead, the front face 1014 is substantially flat and can be substantially parallel to a rear face 1027 formed on the rear portion 1004. It should be understood that, although not specifically indicated in FIG. 20, the dimensions and ratios as related to the upper and lower wear indicator grooves 995, 981 of FIGS. 15-16 can also apply to the upper and lower wear indicator grooves 1095, 1081 illustrated in FIGS. 19-20. In some embodiments, such as the cutting edge 1000 illustrated in FIG. 20, at least one depression 1093 can be formed in the rear face 1027 and extend between the inner side portion 1010 and the outer side portion 1012. Although FIG. 20 shows four depressions 1093, embodiments having other numbers of depressions, including zero, are also contemplated.

The body 1001 can also include a bottom face 1075 defined on the bottom portion 1008. The bottom face can extend between the front bottom edge 1040, a rear bottom edge 1058, an inner bottom edge, and an outer bottom edge 1048. A bottom wear edge 1077 can be disposed on the bottom face 1075 between the front bottom edge 1040 and the rear bottom edge 1058 and can extend between the outer bottom edge 1048 and the inner bottom edge or the inner side portion 1010. The bottom wear edge 1077 can be substantially parallel to the front and rear bottom edges 1040, 1058. A bottom wear surface 1079 can be defined on the bottom face 1075 between the front bottom edge 1040 and the bottom wear edge 1077. A bottom cutaway surface 1081 defined on the bottom face 1075 between the rear bottom edge 1058 and the bottom wear edge 1077.

Figure 25:
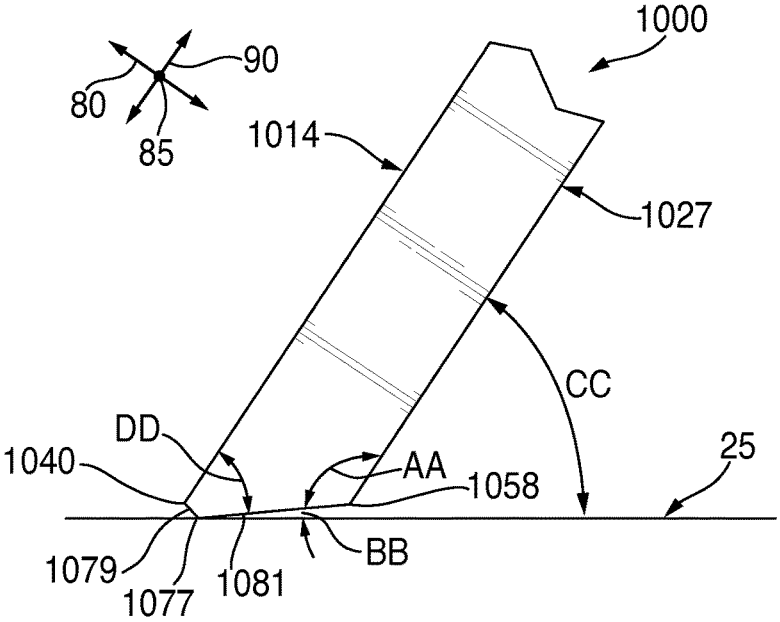
FIG. 25 is a partial side view of the wear member of FIG. 19 engaging a work surface, the wear member constructed in accordance with the principles of the present disclosure.

FIG. 25 illustrates the cutting edge 1000 engaging with a work surface 25. Although not illustrated in FIG. 25, it should be understood that the cutting edge 1000 can be mounted to an earth-working implement so as to position the cutting edge 1000 as shown with respect to the work surface 25. Referring to FIG. 25, a bottom cutaway surface angle AA can be measured as the obtuse angle between the bottom cutaway surface 1081 and the rear face 1027. In some embodiments, the bottom cutaway surface angle AA can be at most about 150 degrees. In other embodiments, the bottom cutaway surface angle AA can be in a range between about 90 degrees and about 150 degrees. In some embodiments, the bottom cutaway surface angle AA can be in a range between about 135 degrees and about 150 degrees. In other embodiments, the bottom cutaway surface angle AA can be in a range between about 140 degrees and about 145 degrees. In other embodiments, the bottom cutaway surface angle AA can be about 143 degrees.

The body 1001 can be configured to be mounted to a mounting edge of the earth-working implement so as to engage the work surface 25. When so mounted, a cutaway work surface angle BB can be measured between the bottom cutaway surface 1081 and the work surface 25. In some embodiments, the cutaway work surface angle can be less than about 3 degrees, and less than about 2 degrees in other embodiments. Additionally, when the body 1001 is mounted to an earth-working implement like as represented in FIG. 25, a rear face surface angle CC can be measured between the rear face 1027 and the work surface 25. In some embodiments, the rear face surface angle CC can be in a range between about 40 degrees and about 60 degrees, or about 45 degrees and about 60 degrees in another embodiment. In some embodiments, the rear face surface angle CC can be about 47 degrees, and can be about 57 degrees in other embodiments.

A wear angle DD can be measured as the acute angle between a front face plane, defined along the front face 1014, and a cutaway surface plane, defined along the bottom cutaway surface 1081. In some embodiments, the wear angle DD can be at least about 30 degrees. In other embodiments, the wear angle DD can be in a range between about 30 degrees and about 90 degrees. In some embodiments, the wear angle DD can be in a range between about 30 degrees and about 45 degrees. In other embodiments, the wear angle DD can be in a range between about 35 degrees and about 40 degrees. In other embodiments, the wear angle DD can be about 37 degrees.

The dimensions, ratios, and angles described above with respect to cutting edge 1000 have been found to yield surprisingly positive results in adding to the wear life of wear members employing those dimensions, such as end cutting-bits or cutting edges. The reduced thickness of the bottom wear surface 1079 as compared to ISO and other standards has been found to improve the ability of a wear member, such as the cutting edge 1000, to cut into a work surface. Additionally, reducing the bottom cutaway surface angle AA in combination with reducing the bottom wear edge depth Z can reduce sliding over the work surface, or the "ski effect", particularly when a wear member has been recently installed. At the same time, decreasing the cutaway work surface angle BB by increasing the bottom cutaway surface angle AA provides increased wear material to engage the work surface as early as possible. This allows a cutting edge, end cutting-bit, or other wear member to more effectively cut into a work surface and increase operating times between the need to switch out wear members, which leads to increased work efficiency.

It should be understood that, where applicable, the dimensional geometric ratios describes herein with respect to the cutting edge 1000 can be applied to any of the other wear member embodiments disclosed herein. For example, although the end cutting-bit 300 shown in FIGS. 8-9 does not explicitly reference a bottom cutaway surface angle AA, it should be understood that the like features of the end cutting-bit 300 could also include the disclosed geometrical relationships and ratios.

Figure 21:
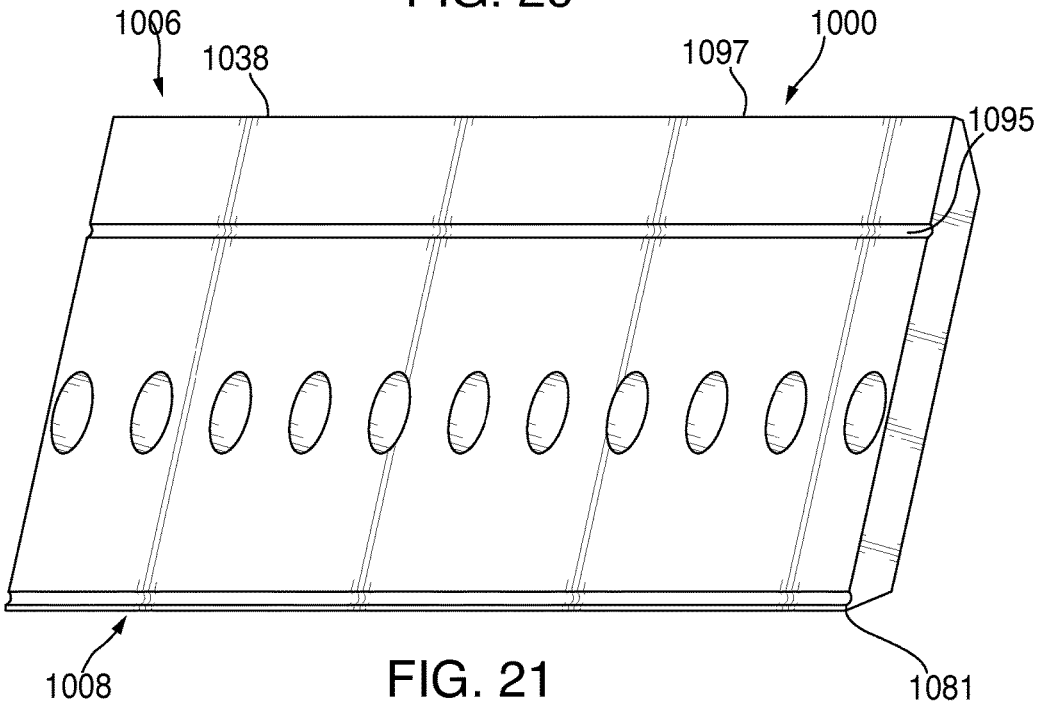
FIG. 21 is a front-right perspective view of the wear member of FIG. 19 after a first wear member life.
Figure 22:
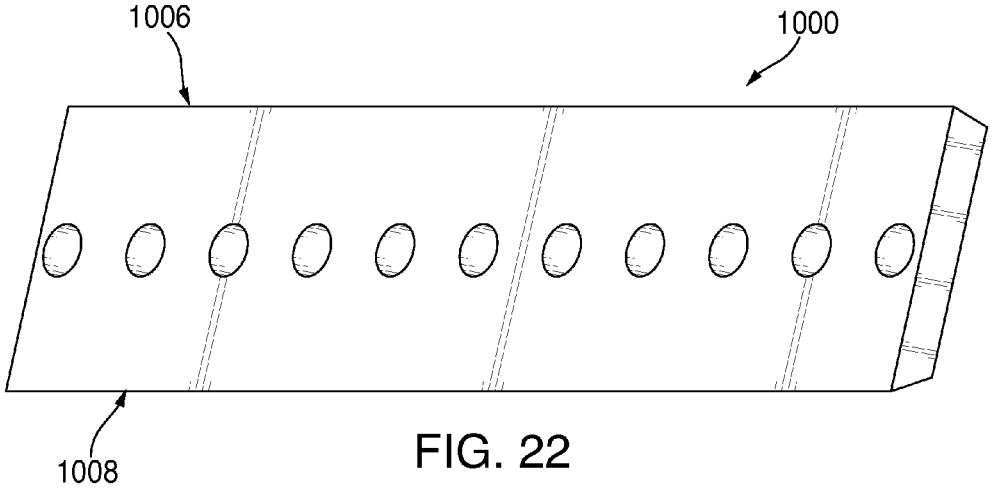
FIG. 22 is a front-right perspective view of the wear member of FIG. 19 after a second wear member life.

An example of the multiple wear lives available to the cutting edge 1000 is illustrated in FIGS. 21-22. FIG. 21 shows cutting edge 1000 after a first life during which the body 1001 was mounted to an earth-working implement such that the lower portion 1008 was disposed to engage a work surface. Eventually, after repetitive use of the cutting edge 1000, the bottom portion 1008 was worn such that the entire lower wear face 1083 was worn way and the work surface was even with the lower wear indicator groove 1081. Upon observing the level of wear illustrated in FIG. 21, an operator or other observer could stop operation in order to flip the cutting edge 1000 to begin a second life. During the second life, the body 1001 would be mounted on the earth-working implement so as to dispose the top portion 1006 of the body 1001 to engage the work surface. FIG. 22 illustrates cutting edge 1000 after the second life. As illustrated, both the top portion 1006 and the bottom portion 1008 have been worn away to the point where nothing is left of either the lower wear face 1083 or the upper wear face 1097. When an operator or other observer determines that a wear member such as cutting edge 1000 has completed its second life, the fully worn wear member can be removed from the earth-working implement and replaced with a new cutting edge or other wear member so as to prevent damage to the earth-working implement.

INDUSTRIAL APPLICABILITY

The industrial application of the wear members as described herein should be readily appreciated from the foregoing discussion. The present disclosure can be applicable to any machine utilizing an earth-working implement for digging, scraping, leveling, excavating or any other suitable application involving engaging the ground or other work material. In machines used for such applications, end cutting-bits, cutting edges, and other types of ground engaging tools can wear out quickly and require replacement.

The present disclosure, therefore, can be applicable to many different machines and environments. One exemplary use of the wear members of this disclosure can be in mining applications in which machine implements can be commonly used to cut, scrape, dig, or clear various work materials including rock, gravel, sand, dirt, and others for protracted time periods and with little downtime. In such applications, maximizing wear life for wear members as well as minimizing the risk of damage to the earth-working implements can be advantageous to maximize work efficiency. The present disclosure has features, as discussed, which can increase wear life of wear members as well as aide in determining the appropriate time to change or rotate wear members on an earth-working implement.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A wear member for an earth-working implement, the wear member comprising:

a body having front, rear, top, bottom, inner side and outer side portions;

a front bottom edge defined along at least a portion of a front bottom interface between the front portion and the bottom portion, the front bottom edge aligned along a longitudinal axis;

a front top edge defined along at least a portion of a front top interface between the front portion and the top portion, the front top edge substantially parallel to the front bottom edge;

a front inner side edge defined along at least a portion of a front inner side interface between the inner side portion and the front portion;

a front outer side edge defined along at least a portion of a front outer side interface between the outer side portion and the front portion;

a front face defined on the front portion, the front face extending between the front inner side edge, the front outer side edge, the front top edge, and the front bottom edge; and a front cutout formed in the front face and extending from the front inner side edge to the front outer side edge and delimited by a front upper cutout edge and a front lower cutout edge, the front upper cutout edge disposed between the front top edge and the front bottom edge, and the front lower cutout edge disposed between the front upper cutout edge and the front bottom edge;

a front lower surface defined on the front face between the front lower cutout edge and the front bottom edge;

a front upper surface defined on the front surface between the front upper cutout edge and the front top edge;

a front cutout surface defined by the front cutout between the front lower cutout edge and the front upper cutout edge, the front cutout surface being offset from the front lower surface and the front upper surface in a direction along a normal axis defined perpendicular to the longitudinal axis;

wherein the body is configured to be mounted to a mounting edge of the earth-working implement such that the front face faces a direction away from the earth-working implement;

a rear bottom edge defined along at least a portion of a rear bottom interface between the bottom portion and the rear portion, the rear bottom edge substantially parallel to the front bottom edge;

a rear top edge defined along at least a portion of a rear top interface between the top portion and the rear portion, the rear top edge substantially parallel to the rear bottom edge;

a rear inner side edge defined along at least a portion of a rear inner side interface between the inner side portion and the rear portion;

a rear outer side edge defined along at least a portion of a rear outer side interface between the outer side portion and the rear portion; and a rear face defined on the rear portion, the rear face extending between the rear inner side edge, the rear outer side edge, the rear top edge, and the rear bottom edge;

wherein the front inner side edge includes an inner lower front portion defined adjacent the front lower surface along the front inner side interface between the inner side portion and the front portion, the inner lower front portion being aligned with a lateral axis defined perpendicular to both the longitudinal axis and the normal axis;

wherein the rear face is substantially parallel to both the front lower surface and the front upper surface; and a ratio between either a lower body thickness or an upper body thickness, measured along the normal axis between the front lower surface or front upper surface and the rear face, and a cutout thickness, measured along the normal axis between the front cutout surface and the rear face, is in a range greater than 1:1 and less than or equal to 3:2.

2. The wear member of claim 1, wherein the front upper surface and the front lower surface are substantially co-planar.

3. The wear member of claim 1, wherein a lateral axis is defined perpendicular to both the longitudinal axis and the normal axis, and wherein a ratio between a front lower surface height, measured along the lateral axis between the front bottom edge and the front lower cutout edge, and a body height, measured along the lateral axis between the front bottom edge and the front top edge, is in a range between 1:10 and 3:10.

4. The wear member of claim 1, wherein a lateral axis is defined perpendicular to both the longitudinal axis and the normal axis, and wherein a ratio between a front upper surface height, measured along the lateral axis between the front top edge and the front upper cutout edge, and a body height, measured along the lateral axis between the front bottom edge and the front top edge, is in a range between 1:10 and 3:10.

5. The wear member of claim 4, wherein a front lower surface height, measured along the lateral axis between the front bottom edge and the front lower cutout edge, is substantially equal to the front upper surface height.

6. The wear member of claim 1 further comprising a wear indicator groove.

7. The wear member of claim 1, wherein the ratio between a lower body thickness, measured along the normal axis between the front lower surface and the rear face, and a cutout thickness, measured along the normal axis between the front cutout surface and the rear face, is in a range greater than 1:1 and less than or equal to 3:2.

8. The wear member of claim 1, wherein the ratio between an upper body thickness, measured along the normal axis between the front upper surface and the rear face, and a cutout thickness, measured along the normal axis between the front cutout surface and the rear face, is in a range greater than 1:1 and less than or equal to 3:2.

9. The wear member of claim 1, wherein an upper body thickness, measured along the normal axis between the front upper surface and the rear face, is substantially equal to a lower body thickness, measured along the normal axis between the front lower surface and the rear face.

10. A wear member for an earth-working implement, the wear member comprising:

a body having front, rear, top, bottom, inner side and outer side portions;

a front bottom edge defined along at least a portion of a front bottom interface between the front portion and the bottom portion, the front bottom edge aligned along a longitudinal axis;

a front top edge defined along at least a portion of a front top interface between the front portion and the top portion, the front top edge substantially parallel to the front bottom edge;

a front inner side edge defined along at least a portion of a front inner side interface between the inner side portion and the front portion;

a front outer side edge defined along at least a portion of a front outer side interface between the outer side portion and the front portion;

a front face defined on the front portion, the front face extending between the front inner side edge, the front outer side edge, the front top edge, and the front bottom edge;

a front cutout formed in the front face and extending from the front inner side edge to the front outer side edge and delimited by a front upper cutout edge and a front lower cutout edge, the front upper cutout edge disposed between the front top edge and the front bottom edge, and the front lower cutout edge disposed between the front upper cutout edge and the front bottom edge;

a front lower surface defined on the front face between the front lower cutout edge and the front bottom edge;

a front upper surface defined on the front surface between the front upper cutout edge and the front top edge, the front upper surface being substantially co-planar with the front lower surface;

a front cutout surface defined by the front cutout between the front lower cutout edge and the front upper cutout edge, the front cutout surface being offset from the front lower surface and the front upper surface in a direction along a normal axis defined perpendicular to the longitudinal axis;

a rear bottom edge defined along at least a portion of a rear bottom interface between the bottom portion and the rear portion, the rear bottom edge substantially parallel to the front bottom edge;

a rear top edge defined along at least a portion of a rear top interface between the top portion and the rear portion, the rear top edge substantially parallel to the front top edge;

a rear inner side edge defined along at least a portion of a rear inner side interface between the inner side portion and the rear portion;

a rear outer side edge defined along at least a portion of a rear outer side interface between the outer side portion and the rear portion; and a rear face defined on the rear portion, the rear face extending between the rear inner side edge, the rear outer side edge, the rear top edge, and the rear bottom edge, the rear face being substantially parallel to the front cutout surface, the front upper surface, and the front lower surface;

wherein the body is configured to be mounted to a mounting edge of the earth-working implement such that the front face faces a direction away from the earth-working implement, and wherein the front inner side edge includes an inner lower front portion defined adjacent the front lower surface along the front inner side interface between the inner side portion and the front portion, the inner lower front portion being aligned with a lateral axis defined perpendicular to both the longitudinal axis and the normal axis; and a ratio between either the lower body thickness or upper body thickness, measured along the normal axis between the front lower surface or front upper surface and the rear face, and a cutout thickness, measured along the normal axis between the front cutout surface and the rear face, is in a range greater than 1:1 and less than or equal to 3:2.

11. The wear member of claim 10, wherein the body includes a wear indicator groove.

12. The wear member of claim 10, wherein the ratio between a lower body thickness, measured along the normal axis between the front lower surface and the rear face, and a cutout thickness, measured along the normal axis between the front cutout surface and the rear face, is in a range greater than 1:1 and less than or equal to 3:2.

13. The wear member of claim 10, wherein the ratio between an upper body thickness, measured along the normal axis between the front upper surface and the rear face, and a cutout thickness, measured along the normal axis between the front cutout surface and the rear face, is in a range greater than 1:1 and less than or equal to 3:2.

14. The wear member of claim 10, wherein an upper body thickness, measured along the normal axis between the front upper surface and the rear face, is substantially equal to a lower body thickness, measured along the normal axis between the front lower surface and the rear face.

15. The wear member of claim 10, wherein a ratio between a front cutout depth, measured along the normal axis between the front lower surface and the front cutout surface, and a lower body thickness, measured along the normal axis between the front lower surface and the rear surface, is in a range between 1:10 and 1:5.

* * * * *